US011137698B2

(12) United States Patent
Kishi et al.

(10) Patent No.: US 11,137,698 B2
(45) Date of Patent: Oct. 5, 2021

(54) IMAGE FORMING APPARATUS INCLUDING NOTIFYING INFORMATION ON DEVELOPING UNIT LIFETIME

(71) Applicant: CANON KABUSHIKI KAISHA, Tokyo (JP)

(72) Inventors: Yosuke Kishi, Suntou-gun (JP); Hirokazu Fujino, Mishima (JP); Masaki Hirose, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/866,779

(22) Filed: May 5, 2020

(65) Prior Publication Data

US 2020/0356024 A1 Nov. 12, 2020

(30) Foreign Application Priority Data

May 10, 2019 (JP) ..... JP2019-090254

(51) Int. Cl.
*G03G 15/00* (2006.01)
*G03G 15/08* (2006.01)

(52) U.S. Cl.
CPC ..... *G03G 15/0848* (2013.01); *G03G 15/087* (2013.01); *G03G 15/0879* (2013.01); *G03G 15/553* (2013.01); *G03G 15/556* (2013.01)

(58) Field of Classification Search
CPC ..... G03G 15/0808; G03G 15/0848; G03G 15/0865; G03G 15/0868; G03G 15/553; G03G 15/556; G03G 2215/0685; G03G 2215/066
USPC ..... 399/27
See application file for complete search history.

(56) References Cited

U.S. PATENT DOCUMENTS

| | | | | |
|---|---|---|---|---|
| 7,831,182 | B2 * | 11/2010 | Konishi | G03G 15/55 399/281 |
| 2009/0238584 | A1 * | 9/2009 | Takeda | G03G 15/0856 399/27 |
| 2011/0069978 | A1 * | 3/2011 | Yamamoto | G03G 15/0856 399/27 |
| 2011/0255884 | A1 * | 10/2011 | Matsuda | G03G 15/55 399/26 |
| 2013/0279921 | A1 * | 10/2013 | Kanai | G03G 15/50 399/12 |

FOREIGN PATENT DOCUMENTS

| | | | |
|---|---|---|---|
| JP | 09197943 A | * | 7/1997 |
| JP | 2000047470 A | * | 2/2000 |
| JP | 2010020041 A | * | 1/2010 |
| JP | 2016161645 A | | 9/2016 |

* cited by examiner

*Primary Examiner* — Robert B Beatty
(74) *Attorney, Agent, or Firm* — Rossi, Kimms & McDowell LLP

(57) ABSTRACT

An image forming apparatus includes an image bearing member, a rotatable developer carrying member, a rotatable toner supplying member, and a toner accommodating unit. A developing unit including the developer carrying member and the toner accommodating unit are capable of being independently exchanged. The image forming apparatus further includes a current detector and a controller configured to execute a process for notifying information on a lifetime of the developing unit, on the basis of a detection result of the current detector at predetermined timing after use of a fresh toner accommodating unit is started.

13 Claims, 10 Drawing Sheets

IMAGE FORMING APPARATUS INCLUDING NOTIFYING INFORMATION ON DEVELOPING UNIT LIFETIME

FIELD OF THE INVENTION AND RELATED ART

The present invention relates to an image forming apparatus, such as a copying machine, a printer or a facsimile machine, of an electrophotographic type.

The image forming apparatus using the electrophotographic type (electrophotographic process, an electrophotographic photosensitive member as an image bearing member is electrically charged uniformly, and the charged photosensitive member is selectively exposed to light, so that an electrostatic image is formed on the photosensitive member. The electrostatic image formed on the photosensitive member is developed (visualized) in a toner image with toner as a developer by a developing device. Then, the toner image formed on the photosensitive member is transferred onto a recording material such as a recording sheet or a plastic sheet directly or via an intermediary transfer member, and the toner image transferred on the recording material is heated and pressed and thus is fixed on the recording material, so that image recording is carried out.

The developing device includes, for example, a developing container for accommodating the toner, a developer carrying member provided so that a part thereof is exposed to an outside of the developing container through an opening of the developing container, a regulating member for regulating an amount of the toner on the developer carrying member, and a supplying member for supplying the toner to the developer carrying member. The regulating member and the supplying member are disposed in contact with a surface of the developer carrying member. Further, as a developing type, for example, there is a contact developing type in which development is carried out in a state in which the photosensitive member and the developer carrying member (specifically a toner layer on the developer carrying member). The contact developing type has an advantage such that a degree of toner scattering is small.

With an increase in image output sheet number (use amount of a developing device) with use of the developing device, the toner in the developing device is rubbed repetitively with the regulating member and the supplying member and is deteriorated. Toner deterioration occurs due to dissociation of an external additive from the toner or the like. By this, flowability of the toner lowers and a depositing force of the toner on the developer carrying member becomes strong, so that filming due to fusion of the toner and the external additive or the like externally added to the toner on the surface of the developer carrying member occurs in some instances. Further, with the increase in image output sheet number, a deposited matter due to the filming is gradually accumulated on the surface of the developer carrying member in some instances.

When the deposited matter due to the filming is accumulated on the surface of the developer carrying member, deterioration of the developer carrying member such as a lowering in surface roughness of the developer carrying member and a rise in electric resistance value of the developer carrying member occurs. Further, when the deterioration of the developer carrying member due to the filming progresses, for example, image defects such as "fog" due to that the toner is not supplied with a desired charge amount and due to density non-uniformity at a half-tone portion generate. Incidentally, the "fog" is a phenomenon such that the toner deposits on a non-image portion on the photosensitive member.

For that reason, in some cases, (an end of) a lifetime of a unit including the developer carrying member is discriminated on the basis of an index value correlating with use amount of the developer carrying member such as a travel distance of the developer carrying member. Incidentally, the index value correlating with the use amount of the developer carrying member may be the travel distance, the number of rotations, a rotation time, the image output sheet number and the like, but herein is collectively and simply referred to as the "travel distance" in some instances.

However, in the case where the (end of) lifetime is discriminated from only the travel distance of the developer carrying member, depending on a use condition (use status, use environment) of the developing device, a deviation between an actual deterioration state of the developer carrying member and timing of notification of the end of lifetime of the unit including the developer carrying member (i.e., that the unit including the developer carrying member reaches the end of lifetime thereof) occurs in some instances. That is, the lifetime of the unit including the developer carrying member which is actually in a continuously usable state is discriminated from only the travel distance, so that notification that the unit reaches the end of lifetime thereof is provided in some cases.

In Japanese Laid-Open Patent Application (JP-A) 2016-161645, for the purpose of improving accuracy of discrimination of the end of lifetime of the unit including the developer carrying member, it has been proposed that with respect to the notification of the end of lifetime of the unit including the developer carrying member discriminated on the basis of the travel distance of the developer carrying member, correction depending on the amount of the toner in the developing device is made.

In a state in which a remaining toner amount in the developing device is small, i.e., in a state in which the developing device is used for a long term and thus deterioration of the toner in the developing device has progressed, the filming is liable to progress. For that reason, as in the above-described conventional example (constitution), by making correction depending on the amount of the toner in the developing device in discrimination of the end of lifetime of the unit including the developer carrying member, it would be considered that a certain effect on improvement of accuracy of the discrimination of the end of lifetime of the unit including the developer carrying member is achieved. However, in this method, an actual filming state and a change in characteristic with the filming are not detected. For that reason, depending on a use (operation) condition of the developing device or the like, a deviation between timing when notification of the end of lifetime depending on the filming state should be provided and timing when the notification of the end of lifetime is actually provided occurs in some instances.

SUMMARY OF THE INVENTION

A principal object of the present invention is to provide an image forming apparatus capable of accurately providing notification of information on an end of a lifetime of a unit including a developer carrying member depending on a degree of deterioration of the developer carrying member.

According to an aspect of the present invention, there is provided an image forming apparatus comprising: an image bearing member configured to bear a toner image; a rotatable developer carrying member configured to carry and feed toner to a portion where the image bearing member is opposed; a rotatable supplying member configured to supply the toner to the developer carrying member in contact with the developer carrying member; a toner accommodating unit in which the toner to be supplied to the developer carrying member is accommodated; wherein a developing unit including the developer carrying member and the toner accommodating unit are capable of being independently exchanged, a current detector configured to detect a current flowing through the supplying member; and a controller configured to execute a process for notifying information on a lifetime of the developing unit, on the basis of a detection result of the current detector at predetermined timing after use of a fresh toner accommodating unit is started.

Further features of the present invention will become apparent from the following description of exemplary embodiments with reference to the attached drawings.

Figure 4:
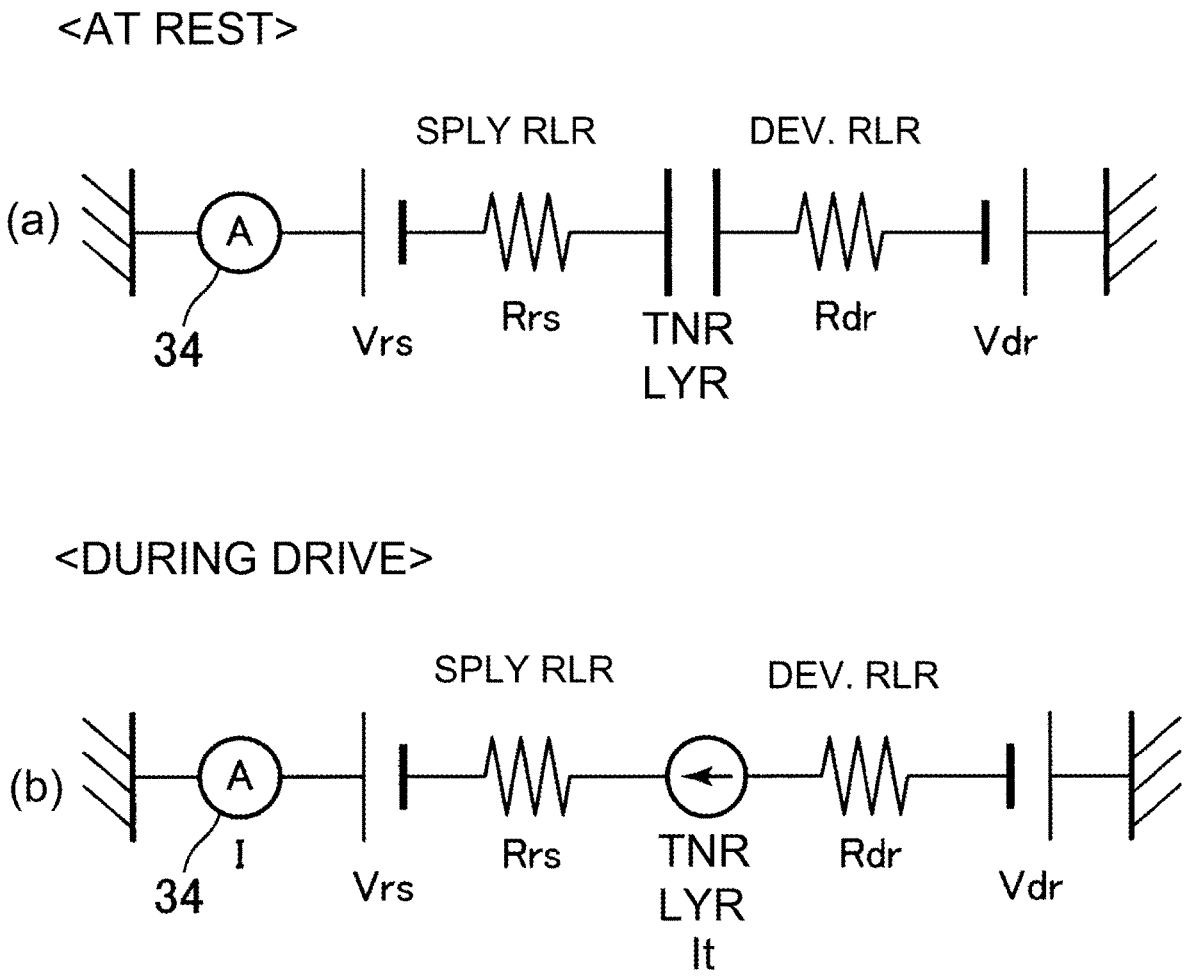

Parts (a) and (b) of FIG. 4 are schematic circuit views each showing a portion relating to a developing roller and a supplying roller.

Figure 5:
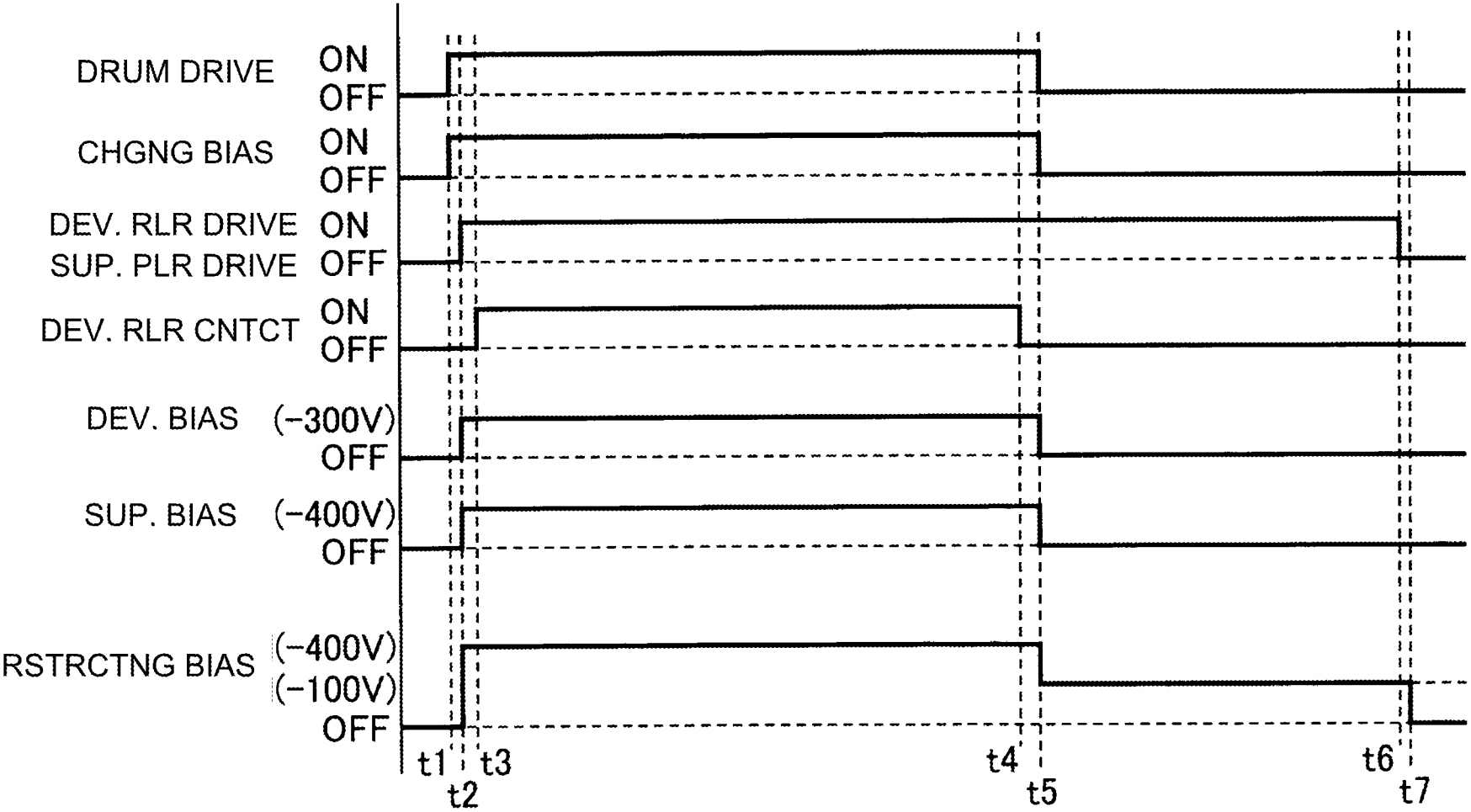

FIG. 5 is a timing chart for illustrating a current detecting operation.

Figure 6:
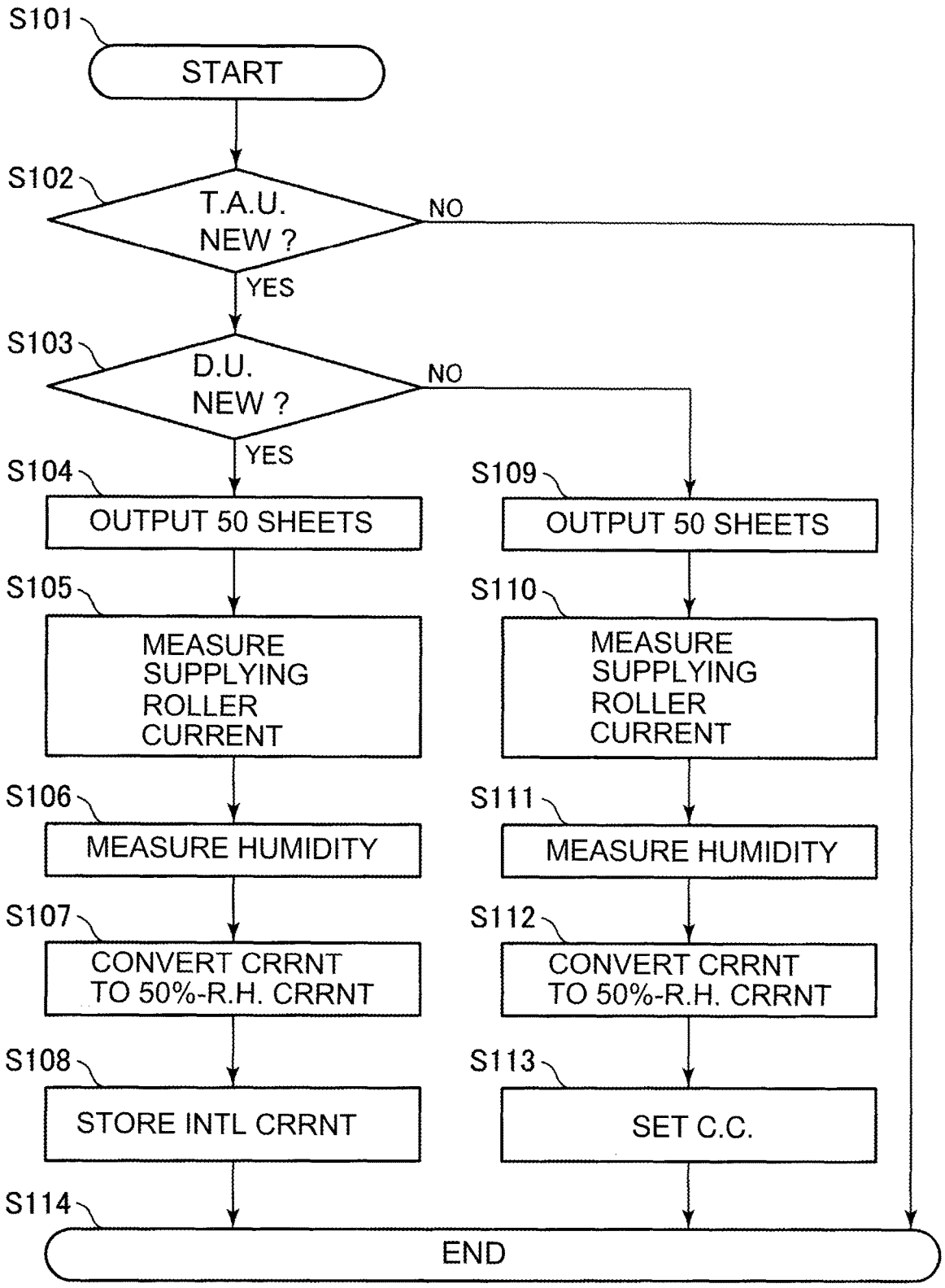

FIG. 6 is a flowchart of a process in which correction coefficient for acquiring a remaining lifetime amount of a developing unit.

Figure 7:
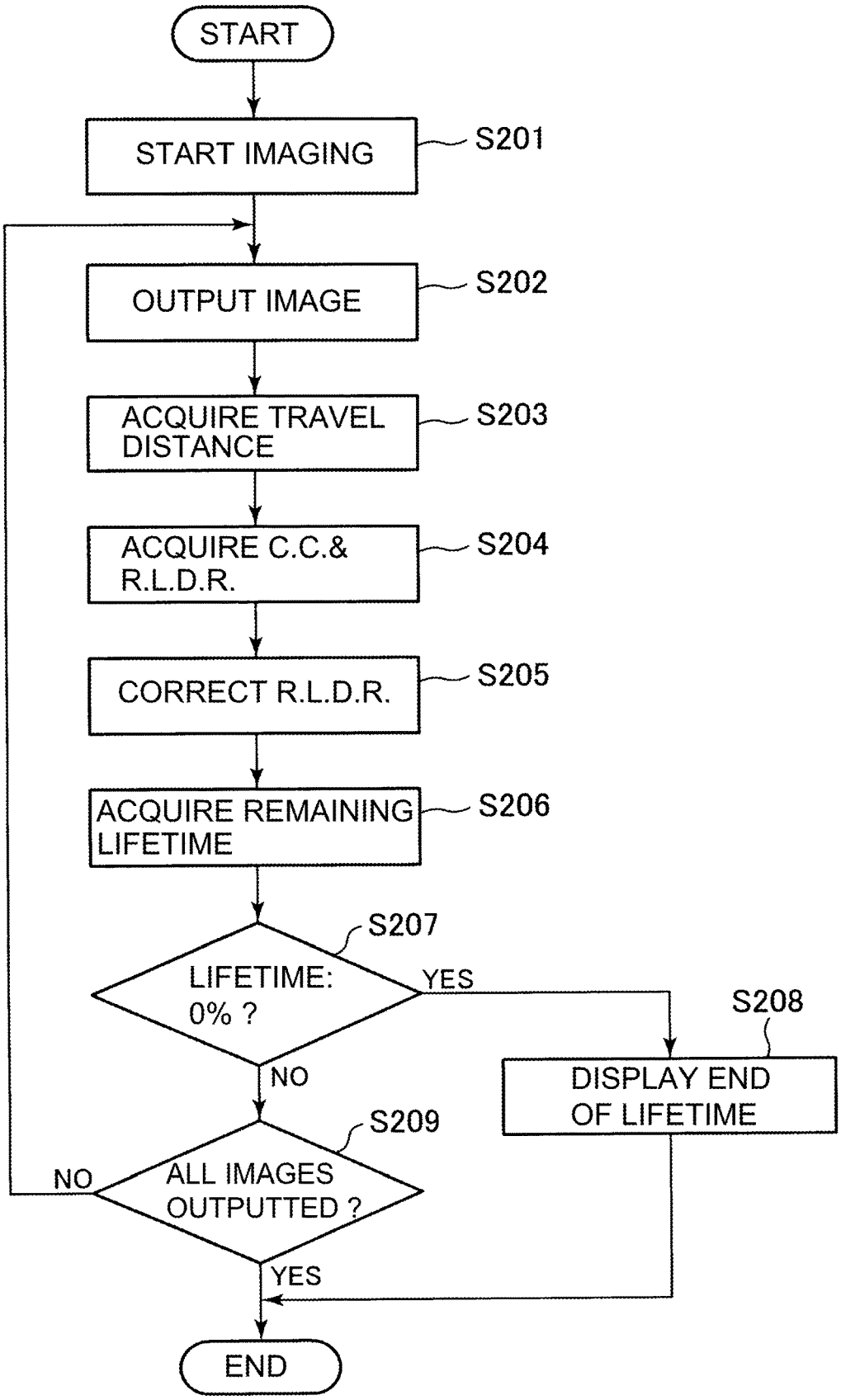

FIG. 7 is a flowchart for illustrating an operation in which an end of lifetime of the developing unit is notified.

Figure 8:
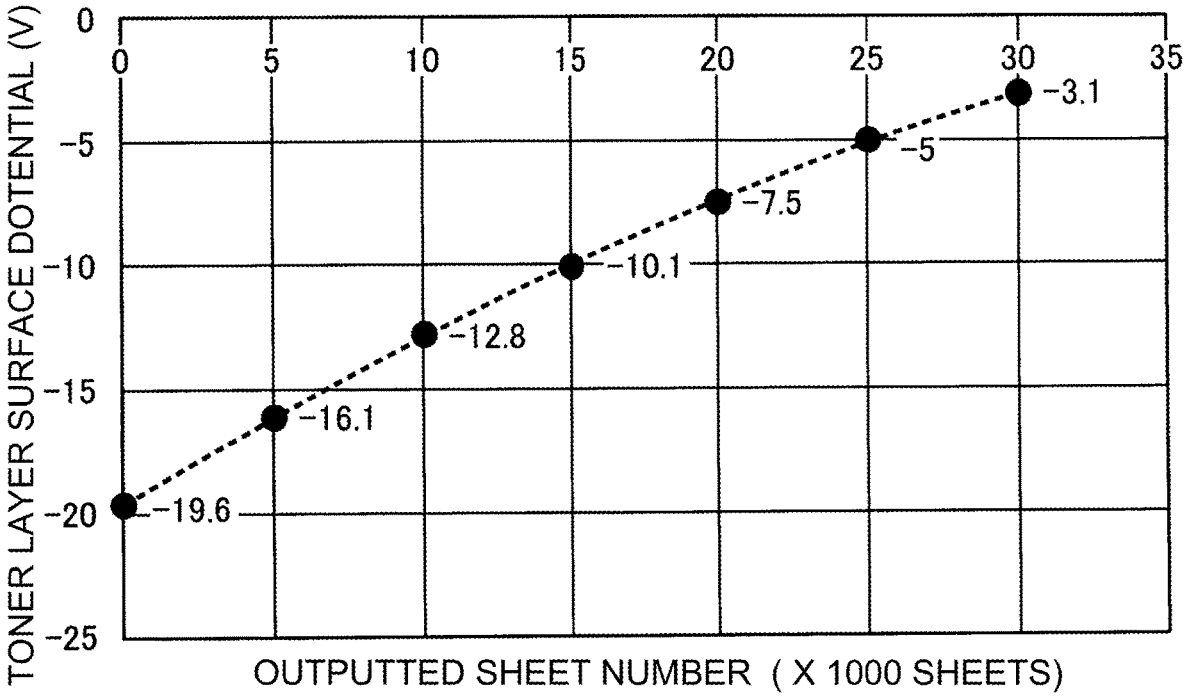

FIG. 8 is a graph showing a relationship between an image output sheet number and a surface potential of a toner layer on the developing roller.

Figure 9:
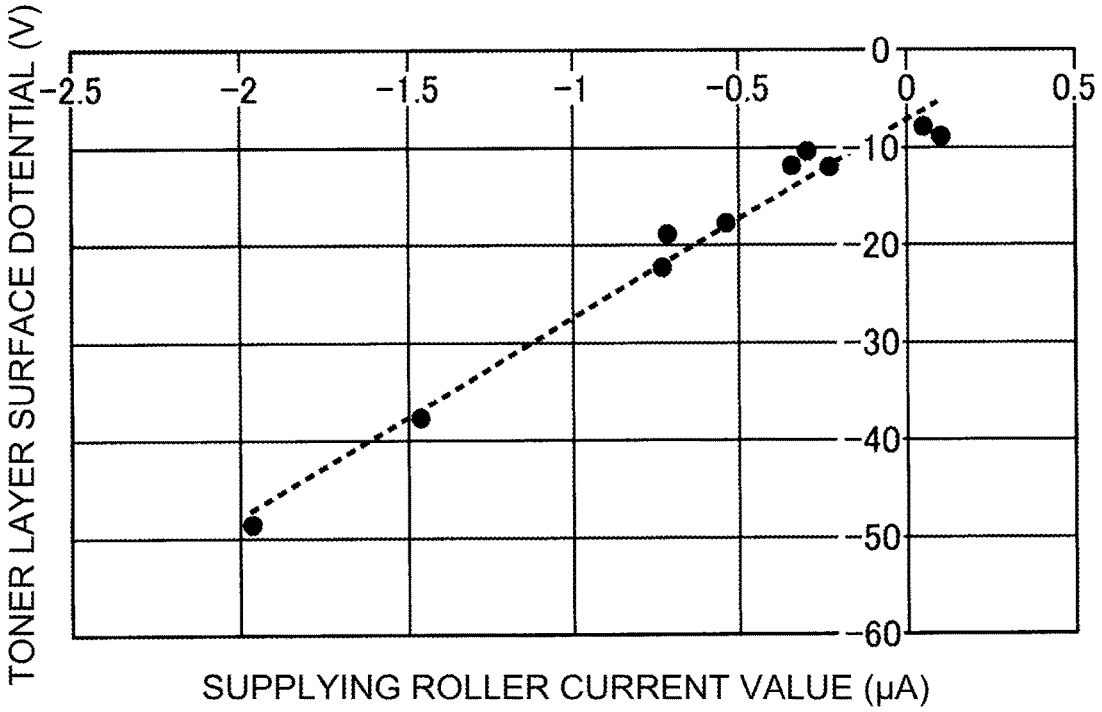

FIG. 9 is a graph showing a relationship between a current flowing through the supplying roller and the surface potential of the toner layer on the developing roller.

Figure 10:
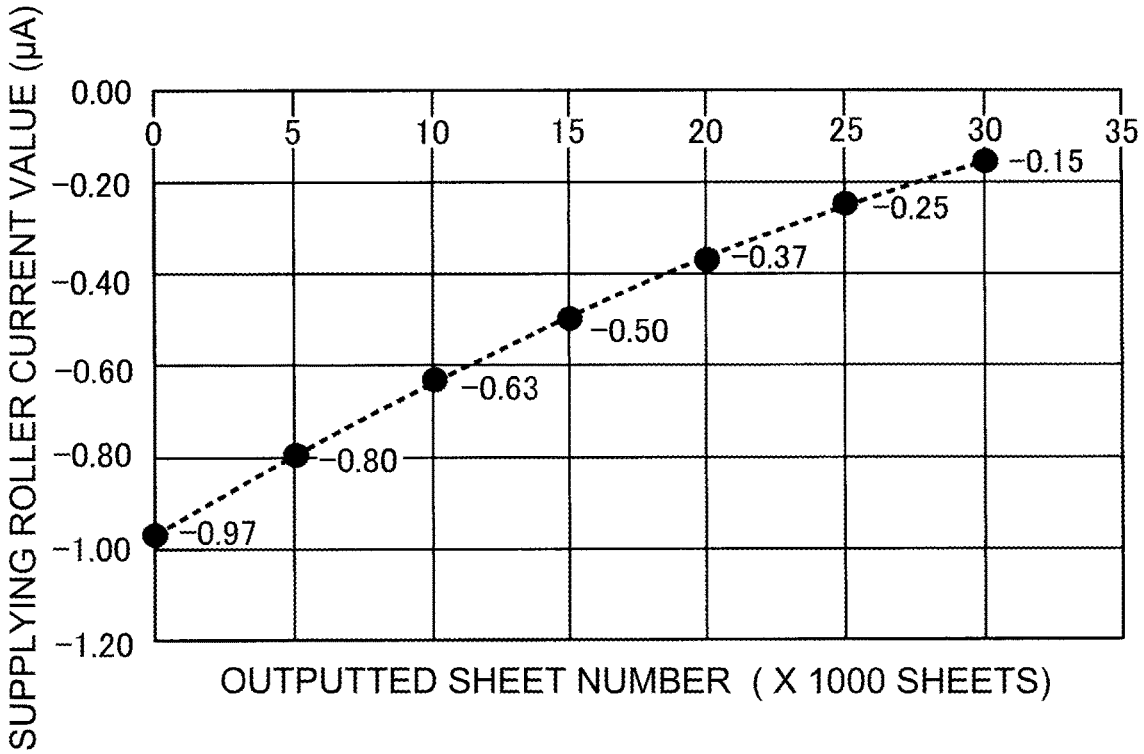

FIG. 10 is a graph showing a relationship between the image output sheet number and the current flowing through the supplying roller.

Figure 11:
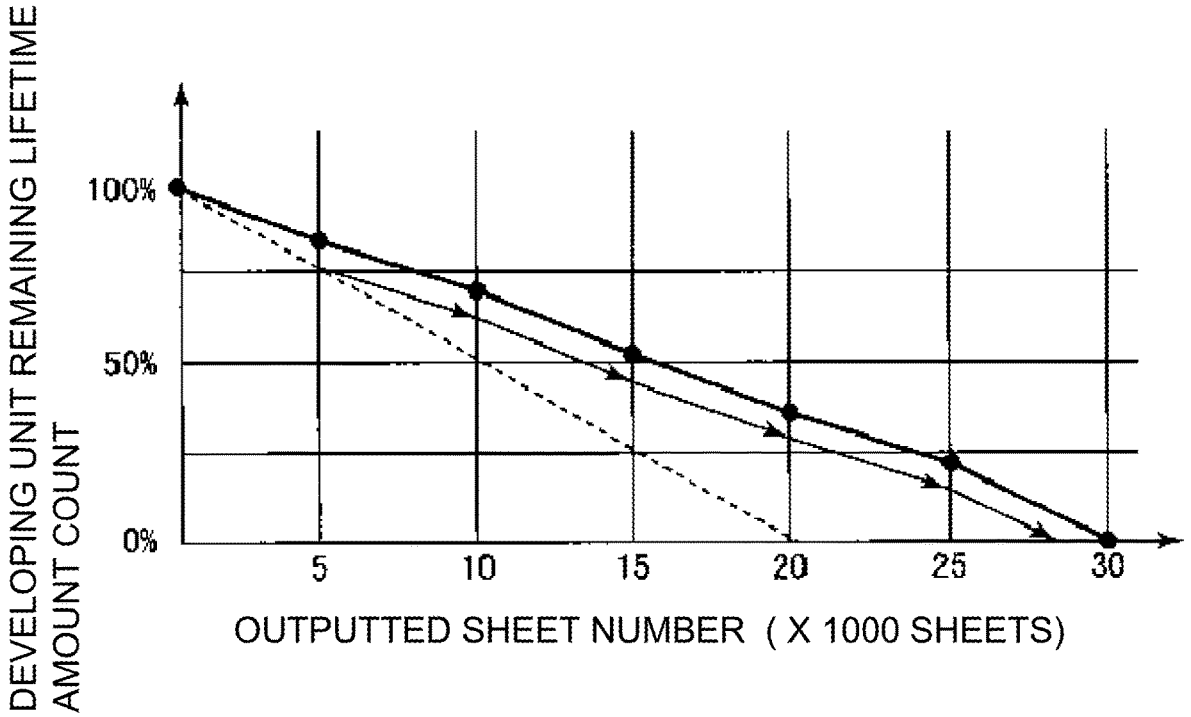

FIG. 11 is a graph for illustrating a method of acquiring the remaining lifetime amount of the developing unit.

Figure 12:
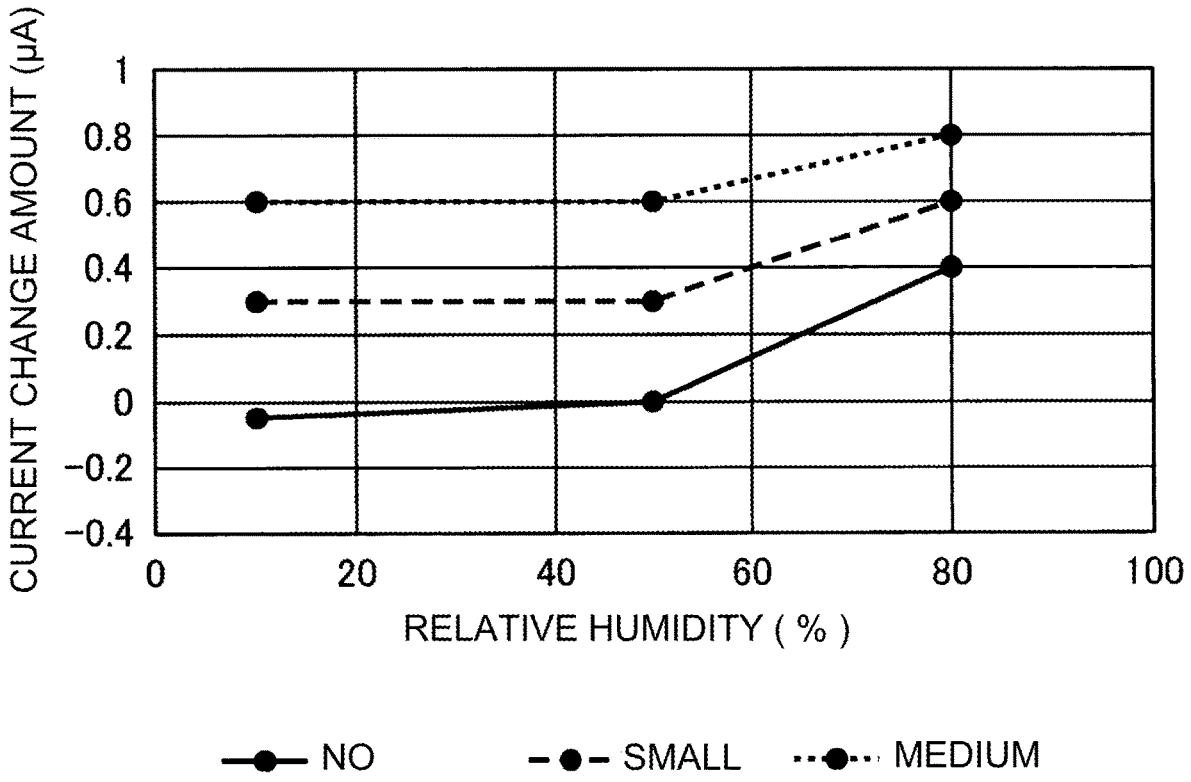

FIG. 12 is a graph for illustrating a relationship between relative humidity and the current flowing through the supplying roller.

DESCRIPTION OF EMBODIMENTS

Hereinbelow, embodiments of the present invention will be specifically described with reference to the drawings. However, dimensions, materials and shapes of constituent elements and their relative arrangements and the like described in the following embodiments should be changed appropriately depending on structures and various conditions of apparatuses (devices) to which the present invention is applied, and the scope of the present invention is not intended to be limited to the following embodiments.

Embodiment 1

1. General Structure and Operation of Image Forming Apparatus

Figure 1:
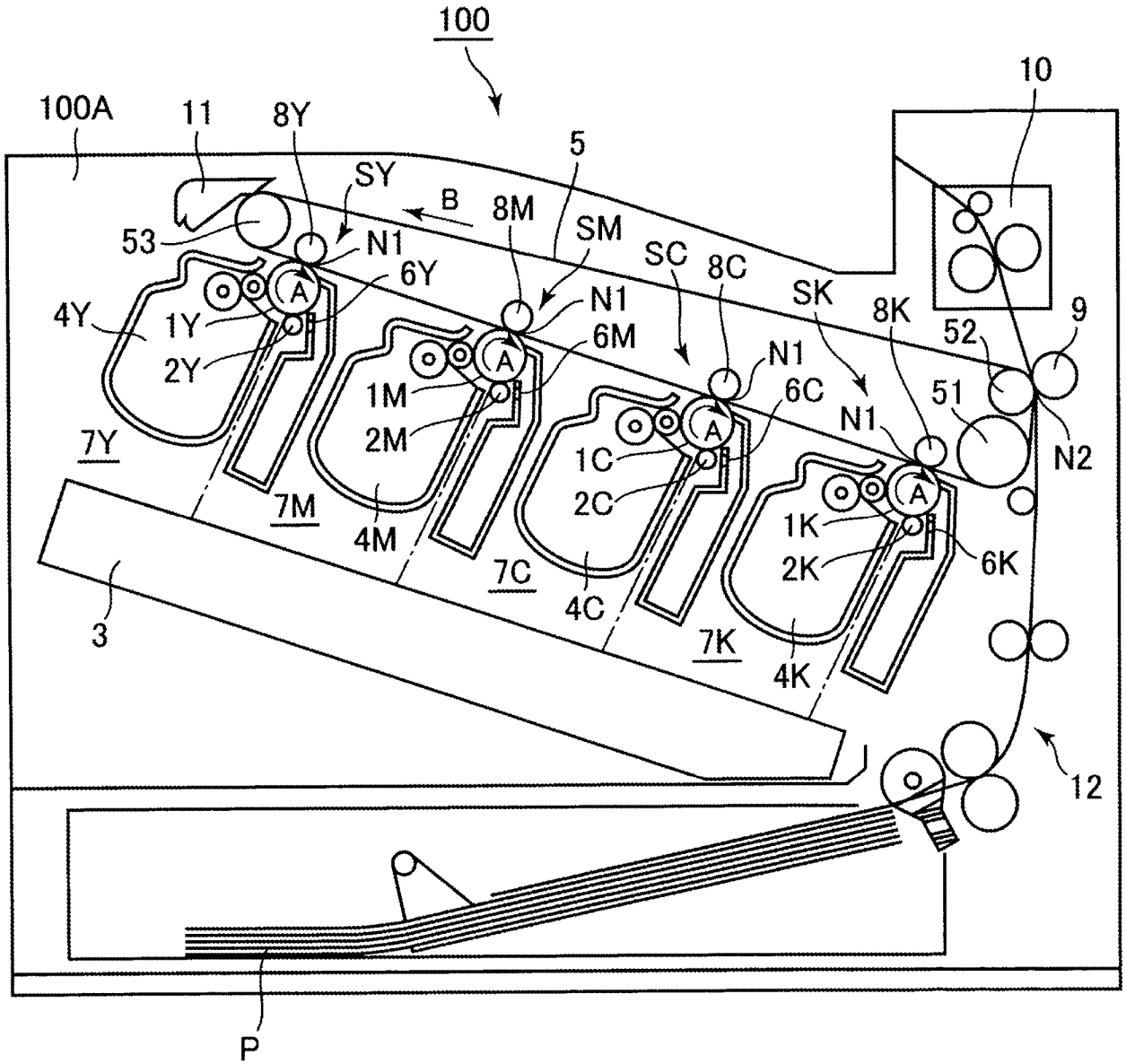
FIG. 1 is a schematic sectional vie of an image forming apparatus.

FIG. 1 is a schematic sectional view of an image forming apparatus 100 in this embodiment. The image forming apparatus 100 in this embodiment is a full-color laser beam printer employing an in-line type and an intermediary transfer type, and is capable of forming a full-color image, in accordance with image information, on a recording material such as a recording sheet, a plastic sheet or cloth. The image information is inputted into an apparatus main assembly 100A from a host device such as an image reader connected with the apparatus main assembly 100A of the image forming apparatus 100 or a personal computer communicatably connected with the apparatus main assembly 100A.

The image forming apparatus 100 includes, as a plurality of image forming portions, first to fourth image forming portions SY, SM, SC and SK for forming images of colors of yellow (Y), magenta (M), cyan (C) and black (K), respectively. In this embodiment, the image forming portions SY, SM, SC and SK are arranged in line in a direction crossing a vertical direction.

In this embodiment, constitutions and operations of the first to fourth image forming portions SY, SM, SC and SK are the substantially same except that the colors of the images to be formed are different from each other. Accordingly, in the following description, in the case where the image forming portions are not particularly required to be distinguished from each other, suffixes Y, M, C and K added to reference numerals for representing elements for the associated colors are omitted, and the elements for the associated colors will be collectively described.

In this embodiment, the image forming apparatus 100 includes four rotatable drum-type (cylindrical) photosensitive drums 1 as image bearing members. The four photosensitive drums 1Y, 1M, 1C and 1K are juxtaposed in a direction crossing the vertical direction. Each of the photosensitive drums 1 is rotationally driven in an indicated arrow A direction (clockwise direction) of FIG. 1 by an unshown drum driving motor 61 (FIG. 3) as a driving means (driving source). A surface of the rotating photosensitive drum 1 is electrically charged to a predetermined potential of a predetermined polarity (negative in this embodiment) by a charging roller 2 which is a charging member of a roller type as a charging means. The electrically charged surface of the photosensitive drum 1 is subjected to scanning exposure by an exposure device (scanner unit) 3, so that an electrostatic (latent) image depending on image information is formed on the photosensitive drum 1. The photosensitive drum 1 is irradiated with laser light modulated depending on the image information. In this embodiment, the exposure device 3 is constituted as a single unit for exposing the respective photosensitive drums 1. The electrostatic image formed on the photosensitive drum 1 is supplied with toner as a developer by a developing device 4 as a developing means and thus is developed (visualized), so that a toner image (developer image) is formed on the photosensitive drum 1. In this embodiment, the developing unit 4 effects reversal development by contacting a developing roller 17 (FIG. 2) as a developer carrying member (described later) to the photosensitive drum 1 (contact development type). That is, in this embodiment, the toner charged to the same polarity (negative in this embodiment) as a charge polarity of the photosensitive drum 1 is deposited on an exposed portion (image portion) where an absolute value of the potential is lowered by the exposure after the photosensitive drum 1 is charged uniformly.

In this embodiment, a normal charge polarity of the toner which is the charge polarity of the toner during development is the negative polarity.

An intermediary transfer belt 5 formed with an endless belt as an intermediary transfer member is provided opposed to the four photosensitive drums 1. The intermediary transfer belt 5 is disposed rotatably in contact with the four photosensitive drums 1. The intermediary transfer belt 5 is extended around, as a plurality of supporting members (stretching rollers), a driving roller 51, a secondary transfer opposite roller 52, and a tension roller 53, is stretched with predetermined tension. The driving roller 51 of the intermediary transfer belt 5 is rotationally driven by an unshown driving motor as a driving means (driving source), so that a driving force is transmitted to the intermediary transfer belt 5, and the intermediary transfer belt 5 is circulated and moved (rotated) in an arrow B direction (counterclockwise direction) in FIG. 1. In an inner peripheral surface side of the intermediary transfer belt 5, as primary transfer means, primary transfer rollers 8 which are roller-type primary transfer members are provided corresponding to the associated photosensitive drums 1, respectively. Each of the primary transfer rollers 8 urges the intermediary transfer belt 5 toward the associated photosensitive drum 1 and forms a primary transfer portion (primary transfer nip) N1 where the intermediary transfer belt 5 and the photosensitive drum 1 contact each other. As described above, the toner image formed on the photosensitive drum 1 is transferred (primary-transferred) onto the intermediary transfer belt 5 as a rotating toner image-receiving member by the action of the primary transfer roller 8. During a primary transfer step, to the primary transfer roller 8, from a primary transfer bias voltage source (high voltage source) as a bias (voltage) applying means, a primary transfer bias (primary transfer voltage) of an opposite polarity (positive in this embodiment) to the normal charge polarity of the toner is applied. For example, during full-color image formation, the toner images of yellow, magenta, cyan and black formed on the photosensitive drums 1Y, 1M, 1C and 1K are successively transferred superposedly onto the intermediary transfer belt 5. In an outer peripheral surface (front surface) side, at a position opposing the secondary transfer opposite roller 52, a secondary transfer roller 9 which is a roller-type secondary transfer member as a secondary transfer means is provided. The secondary transfer roller 9 urges the intermediary transfer belt 5 toward the secondary transfer opposite roller 52, and forms a secondary transfer portion (secondary transfer nip) N2 where the intermediary transfer belt 5 and the secondary transfer roller 9 contact each other. The toner images formed on the intermediary transfer belt 5 as described above are transferred (secondary-transferred) onto a recording material P as a toner image-receiving member fed while being nipped between the intermediary transfer belt 5 and the secondary transfer roller 9, by the action of the secondary transfer roller 9 in the secondary transfer portion N2. During a secondary transfer step, to the secondary transfer roller 9, from a secondary transfer voltage source (high voltage source) as a bias (voltage) applying means, a secondary transfer bias (secondary transfer voltage) of the opposite polarity (positive in this embodiment) to the normal charge polarity of the toner is applied. The recording material P is timed to the toner images on the intermediary transfer belt 5 by a feeding device 12 and is supplied to the secondary transfer portion N2.

The recording material P on which the toner images are transferred is fed to a fixing device 10 as a fixing means. The fixing device 10 applies heat and pressure to the recording material P carrying unfixed toner images, so that the toner images are fixed on the recording material P. The recording material P on which the toner images are fixed is discharged (outputted) to an outside of the apparatus main assembly 100A.

Toner (primary transfer residual toner) remaining on the photosensitive drum 1 after the primary transfer step is removed from the photosensitive drum 1 by a drum cleaning device 6 as a photosensitive member means and then is collected. Further, toner (secondary transfer residual toner) remaining on the intermediary transfer belt 5 after the secondary-transfer step is removed from the intermediary transfer belt 5 by an intermediary transfer belt cleaning device 11 and then is collected.

In this embodiment, the image forming apparatus 100 can also form a monochromatic (single-color) image or a multicolor image by using only a desired one image forming portion or only several (but not all of) desired image forming portions. Further, in this embodiment, in each of the image forming portions S, the photosensitive drum 1, and as process means actable on the photosensitive drum 1, the charging roller 2, the developing device 4 and the drum cleaning device 6 are integrally assembled into a cartridge, so that a process cartridge 7 is formed. The process cartridge 7 is mountable in and dismountable from the apparatus main assembly 100A through mounting means, such as mounting guides and positioning members, which are provided in the apparatus main assembly 100A. In this embodiment, the process cartridges 7 for the respective colors have the substantially same shape, and in the process cartridges 7 for the respective colors, the toners of the respective colors of yellow (Y), magenta (M), cyan (C) and black (K) are accommodated.

2. Process Cartridge

Next, the process cartridge 7 will be further described.

Figure 2:
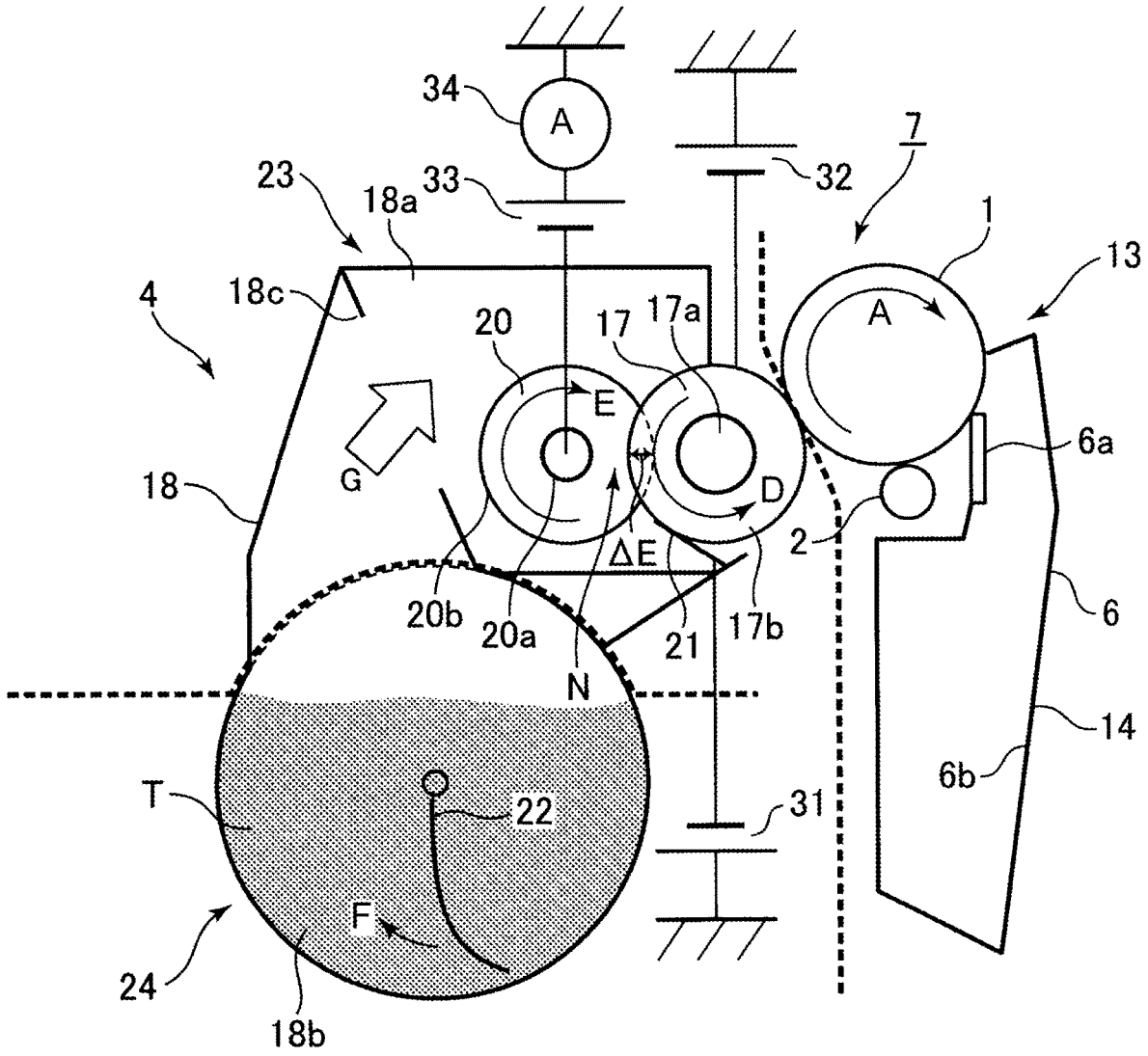
FIG. 2 is a schematic sectional view of a process cartridge.

FIG. 2 is a schematic sectional view (principal sectional view) of the process cartridge 7 in this embodiment as seen along a longitudinal direction (rotational axis direction) of the photosensitive drum 1. In this embodiment, structures and operations of the process cartridges 7 for the respective colors are the substantially same except for species (colors) of the toners accommodated.

The cartridge 7 has a structure in which a photosensitive member unit 13 including the photosensitive drum 1 and the like and the developing device 4 including a developing roller 17 and the like are integrally assembled.

The photosensitive member unit 13 includes a cleaning frame 14 as a frame for supporting various elements (components) in the photosensitive member unit 13. To the cleaning frame 14, the photosensitive drum 1 is rotatably secured via unshown bearings. The photosensitive drum 1 is rotationally driven in an arrow A direction (clockwise direction) in FIG. 2 depending on an image forming operation by transmitting a driving force from a drum driving motor 61 (FIG. 3) as a driving means (driving source). In this embodiment, the photosensitive drum 1 is an organic photosensitive drum obtained by successively coating an outer peripheral surface of an aluminum cylinder with an under-coat layer, a carrier generating layer and a carrier transporting layer which are functional films.

To the cleaning frame 14, the charging roller 2 is rotatably mounted via unshown bearings. The charging roller 2 is provided in contact with the outer peripheral surface of the photosensitive drum 1. In this embodiment, the charging roller 2 is constituted by an electroconductive core metal and an elastic layer (rubber layer) formed with an electroconductive rubber at a periphery of the core metal, and the rubber layer is pressure-contacted to the photosensitive drum 1, so that the charging roller 2 is rotated with rotation of the photosensitive drum 1. During a charging step, to the core metal of the charging roller 2, a charging bias (charging voltage) which is a predetermined DC voltage is applied, from a charging voltage source (high voltage source) 41 (FIG. 3) as a bias (voltage) applying means. By this, a uniform dark-portion potential (Vd) is formed on the surface of the photosensitive drum 1. The charged photosensitive drum 1 is exposed to a spot pattern of the laser light emitted from the exposed device 3 corresponding to image data. At an exposed portion of the photosensitive drum 1, surface electric charges disappear by carriers from the carrier generating layer, so that an absolute value of the potential lowers. As a result, at the exposed portion of the photosensitive drum 1, a predetermined light-portion potential (Vl) is formed. As a result, on the photosensitive drum 1, the electrostatic latent image with a predetermined dark-portion potential (VD) at an unexposed portion (non-exposure portion, non-image portion) and the light-portion potential (Vl) at the exposed portion (exposure portion, image portion) is formed. In this embodiment, during image formation (during electrostatic image formation), the dark-portion potential (Vd)=−400 V and the light-portion potential (Vl)=−100 V were set.

Further, to the cleaning frame 14, a cleaning blade 6*a* as a cleaning member is mounted. The cleaning blade 6*a* scrapes off the primary transfer residual toner from the surface of the rotating photosensitive drum 1. The primary transfer residual toner removed from the surface of the photosensitive drum 1 by the cleaning blade 6*a* drops into toner collecting chamber 6*b* and is accommodated in the toner collecting chamber. By the cleaning frame 14 and the cleaning blade 6*a* which constitute the toner collecting chamber 6*b*, the drum cleaning device is constituted.

The developing device 4 includes a developing chamber 18*a* and a toner accommodating chamber 18*b* as a developer accommodating portion and further includes a developing (device) frame (developing container) 18 as a frame for supporting various elements (components) of the developing device 4. In the developing chamber 18*a*, a developing roller 17 as a developer carrying member for carrying the toner, a supplying roller 20 as a supplying member for supplying the toner to the developing roller 17, and a developing blade 21 as a regulating member for regulating an amount of the toner on the developing roller 17 are provided. The supplying roller 20 also has a function of peeling (scraping) off, of the developing roller 17, the toner remaining on the developing roller 17 without being subjected to development at a developing portion opposing (contacting) the photosensitive drum 1. Inside the toner accommodating chamber 18*b*, toner T is accommodated. In this embodiment, the toner accommodating chamber 18*b* is disposed below the supplying roller 20 with respect to the direction of gravitation and communicates with the developing chamber 18*a* through a developing opening 18*c*. Further, inside the toner accommodating chamber 18*b*, a stirring and feeding member 22 is provided. The stirring and feeding member 22 not only stirs the toner accommodated inside the toner accommodating chamber 18*b* but also feeds the toner T toward an upper portion of the supplying roller 20 in an arrow G direction in FIG. 2. In this embodiment, the stirring and feeding member 22 is rotationally driven at 30 rpm in an arrow F direction (clockwise direction) in FIG. 2. Further, in this embodiment, in the toner accommodating chamber 18*b*, 100 g of the toner 7 in an initial (fresh) state is accommodated.

The developing roller 17 rotates in an arrow D direction (counterclockwise direction) in contact with the photosensitive drum 1. That is, the developing roller 17 and the photosensitive drum 1 rotate so that their surfaces move in the same direction (direction from below toward above in this embodiment) at their opposing portion (contact portion). The developing roller 17 is constituted by including an electroconductive core metal 17*a* and an elastic layer (rubber layer) 17*b* formed with a semi-conductive rubber at a periphery of the core metal 17*a*. Further, in this embodiment, roughly, the developing roller 17 contacts the photosensitive drum 1 at predetermined timing only during image formation (during development) and is separated from the photosensitive drum 1 in a stand-by state or the like. The image forming apparatus 100 includes a contact and separation mechanism 71 (FIG. 3) as a contact and separation means for contacting the developing roller 17 to the photosensitive drum 1 and separating the developing roller 17 to the photosensitive drum 1. Roughly, the contact and separation mechanism 71 causes the developing roller 17 to contact the photosensitive drum 1 and separate from the photosensitive drum 1 by rotating the developing device 4 mounted to the photosensitive member unit 13 so as to be rotatable about a rotational axis of the developing device 4. The developing roller 17 may also be constituted so as to be always disposed close to the photosensitive drum 1 with a predetermined interval (distance).

During the developing step, to the core metal 17*a* of the developing roller 17, a developing bias (developing voltage) which is a predetermined DC voltage is applied from a developing voltage source 32 as a bias (voltage) applying means. The toner charged to the negative polarity by triboelectric charge through rubbing with the developing blade 21 described later is transferred onto only the light-portion potential portion on the photosensitive drum 1 by a potential difference between the light-portion potential on the photosensitive drum 1 and a developing bias Vdr. The developing bias during the image formation has the same polarity as the normal charge polarity of the toner, and is set at a voltage value of which absolute value is smaller than an absolute value of the dark-portion potential and is larger than an absolute value of the light-portion potential. In this embodiment, during the image formation, by setting the developing bias Vdr=−300 V, a potential difference ΔV between the light-portion potential and the developing roller 17 was made 200 V. Here, the potential difference between the potential on the photosensitive drum 1 and the developing roller 17 is represented by a potential difference between the potential on the photosensitive drum 1 and the developing bias.

The supplying roller 20 forms a supplying portion (supplying nip) N in contact with the developing roller 17 and rotates in the arrow E direction (clockwise direction) with a peripheral speed difference relative to the developing roller 17. That is, the supplying roller 20 and the developing roller 17 rotate so that their surfaces move in the same direction (direction from above toward below) at the contact portion with a peripheral speed difference therebetween. The supplying roller 20 is an elastic sponge roller constituted by including an electroconductive more metal 20*a* and an elastic layer (foam layer) 20*b* formed with a foam at a periphery of the core metal 20*a*. The supplying roller 20 is contacted to the developing roller 17 with a predetermined penetration (entering) amount. Here, in this embodiment, the penetration amount of the supplying roller 20 into the developing roller 17 refers to a recessed amount ΔE in which the supplying roller 20 is recessed (depressed) by the developing roller 17 as shown in FIG. 2. The supplying roller 20 supplies the toner to the developing roller 17. Further, the supplying roller 20 peels off the toner remaining on the developing roller 17 after the toner passes through the developing portion. At that time, to the core metal 20*a* of the supplying roller 20, a supplying bias (supplying voltage) which is a predetermined PC voltage is applied from a supplying (roller) voltage source 33 as a bias (voltage) applying means. By this, a supply amount of the toner to the developing roller 17 can be controlled by adjusting the potential difference between the developing roller 17 and the supplying roller 20. The supplying bias during the image formation is set at a voltage which has the same polarity as the normal charge polarity of the toner and which has an absolute value larger than an absolute value of the developing bias. In this embodiment, the supplying roller 20 rotates at a rotational speed of 200 rpm, and the developing roller 17 rotates at a rotational speed of 100 rpm. Further, in this embodiment, during the image formation, a supplying (roller) bias Vrs was set at −400 V.

In this embodiment, the developing blade 21 is disposed under the developing roller 17 and is contacted counterdirectionally (with respect to a direction in which a free end faces an upstream side with respect to the rotational direction of the developing roller 17) to the surface of the developing roller 17. The developing blade 21 regulates a coating amount of the toner supplied to the developing roller 17 by the supplying roller 20 and imparts electric charges to the toner through triboelectric charge. In this embodiment, as the developing blade 21, a 0.1 mm-thick leaf spring-shaped thin plate of SUS which is an electroconductive member was used, whereby a predetermined contact pressure was formed by utilizing spring elasticity of the thin plate. In this embodiment, the developing blade 21 is surface-contacted to the developing roller 17 (specifically, the toner layer on the developing roller 17). In this embodiment, the contact pressure of the developing blade 21 to the developing roller 17 is 30 gf/cm as center setting, but changes within a range of 20-40 gf/cm depending on variations of the developing blade 21 alone and during assembling of the developing blade 21 in some instances. Incidentally, a material of the developing blade 21 is not limited to the above material in this embodiment, but may also be a thin plate of metal such as phosphor bronze or aluminum, for example. Further, as the developing blade 21, those surface-coated with a thin film of polyamide elastomer, urethane rubber, urethane resin or the like may also be used. The toner is triboelectrically charged by rubbing between the developing blade 21 and the developing roller 17 (specifically the toner layer on the developing roller 17), so that electric charges are imparted to the toner and a layer thickness of the toner is regulated. Further, in this embodiment, in that case, to the developing blade 21, a regulating bias (regulating voltage) which is a predetermined DC bias is applied from a regulating voltage source 31 as a bias (voltage) applying means. As a result, coating of the toner on the developing roller 17 is stabilized. The regulating bias during the image formation is set at a voltage which has the same polarity as the normal charge polarity of the toner and which has an absolute value larger than the absolute value of the developing bias. In this embodiment, during the image formation, a regulating bias Vbl=−400 V was set. Incidentally, a potential difference between the developing blade 21 and the developing roller 17 may preferably be 500 V or less. In the case where this potential difference is larger than 500 V, there is a possibility that electric discharge generates between the developing blade 21 and the developing roller 17 and thus the toner layer and the charge amount of the toner become unstable.

The developing roller 17, the supplying roller 20 and the stirring and feeding member 22 are rotationally driven in the above-described directions, respectively, depending on the image forming operation through transmission of the driving force from a developing (means) driving motor 62 (FIG. 3) as a driving means (driving source).

Further, in this embodiment, in the developing device 4, the developing chamber 18*a*, and the developing roller 17, the supplying roller 20 and the developing blade 21 which are provided in the developing chamber 18*a* are integrally assembled into a cartridge, so that a developing unit 23 is formed. Further, in the developing device 4, the toner accommodating chamber 18*b* and the stirring and feeding member 22 provided in the toner accommodating chamber 18*b* are integrally assembled into a cartridge, so that a toner accommodating unit 24 is formed. In this embodiment, in the cartridge 7, each of the photosensitive member unit 13, the developing unit 23 and the toner accommodating unit 24 is constituted so as to be independently exchangeable. When the toner accommodating unit 24 and the developing unit 23 are mounted, the toner accommodating chamber 18*b* formed in the toner accommodating unit 24 and the developing chamber 18*a* formed in the developing unit 23 are caused to communicate with each other through the developing opening 18*c*.

3. Developing Roller and Supplying Roller

Next, the developing roller 17 in this embodiment will be further described. In this embodiment, the developing roller 17 is constituted by including an electroconductive support 17*a* and an elastic layer (rubber layer) 17*b* formed with a semiconductive rubber in which an electroconductive agent is contained, at a periphery of the electroconductive support 17*a*. In this embodiment, at a periphery of a core metal electrode of 6 mm in outer diameter as the electroconductive support 17*a*, a semiconductive silicone rubber layer in which the electroconductive agent is contained is provided as the rubber layer 17*b*. In this embodiment, the silicone rubber layer is coated with an acrylic-urethane rubber layer of about 200 μm in thickness, so that an outer diameter of entirety of the developing roller 17 is 12 mm. Further, in this embodiment, an electric resistance of the developing roller 17 is $1\times10^6$ (Ω).

Here, a measuring method of the electric resistance of the developing roller 17 will be described. The developing roller 17 is contacted to an aluminum sleeve of 30 mm in diameter with a contact load of 9.8 N. By rotating this aluminum sleeve, the developing roller 17 is rotated at 60 rpm with the aluminum sleeve. Then, a DC voltage of −50 V is applied to the developing roller 17. At that time, a resistor of 10 kΩ is provided on the ground side, and a voltage of both terminals thereof is measured, and thus a current is calculated, so that the electric resistance of the developing roller 17 is calculated.

Incidentally, when a volume resistance of the developing roller 17 is larger than $1\times10^9$ (Ω), a voltage value of the developing bias at the surface of the developing roller 17 lowers, and a DC electric field in a developing region decreases and thus developing efficiency lowers, so that there is a possibility that an image density lowers. Accordingly, the electric resistance of the developing roller 17 may preferably be $1\times10^9$ (Ω) or less.

Further, as regards a surface shape of the developing roller 17, it is preferable that surface roughness of the developing roller 17 is controlled for compatibly realizing a high image quality and high durability. As the surface roughness of the developing roller 17, for example, setting thereof may preferably be made so that Ra (μm) (JIS B 0601) is 3.0 or less from the viewpoint that a stable toner feeding amount is obtained. When the surface roughness Ra (μm) of the developing roller 17 exceeds 3.0, the toner feeding amount on the developing roller 17 increases, and charge impartment to the toner by friction with the developing blade 21 becomes insufficient, so that there is a possibility that "fog" occurs on a white background portion.

The supplying roller 20 in this embodiment will be further described. In this embodiment, the supplying roller 20 is constituted by including an electroconductive support 20*a* and an elastic layer (foam layer) 206 formed with a foam member at a periphery of the electroconductive support 20*a*. In this embodiment, at the periphery of a core metal electrode of 5 mm in outer diameter as the electroconductive support 20*a*, a foam urethane layer of an open-cell type in which air bubbles as the foam layer 20*b* connect with each other. A surface layer of urethane has the open-cell structure, so that the toner can enter the supplying roller 20 in a relatively large amount. In this embodiment, an electrical resistance of the supplying roller 20 is $1\times10^{7}\Omega$.

A measuring method of the electrical resistance of the supplying roller 20 will be described. The supplying roller 20 is contacted to an aluminum sleeve of 30 mm in diameter so as to have a penetration amount of 1.5 mm. By rotating the aluminum sleeve, the supplying roller 20 is rotated at 30 rpm by rotation of the aluminum sleeve. Then, a DC voltage of −50 V is applied to the supplying roller 20. At that time, a resistor of 10 kΩ is provided on the ground side and a voltage at both terminals is measured, so that a current is calculated and then the electrical resistance of the supplying roller 20 is calculated.

Incidentally, the electric resistance of the supplying roller 20 may preferably be $1\times10^{8}\Omega$ or less. When the electric resistance of the supplying roller 20 is larger than $1\times10^{8}\Omega$, there is a possibility that detection accuracy of a current flowing through the supplying roller 20 described later lowers. Here, the electric resistance of the supplying roller 20 is $1\times10^{3}\Omega$ or more in general from the viewpoints of ensuring of mechanism characteristic and for the reason of manufacturing and the like.

A surface cell diameter of the supplying roller 20 was about 50 μm to about 1000 μm in this embodiment. Here, the cell diameter refers to an average diameter of a foam cell in an arbitrary cross-section. First, from an enlarged image of the arbitrary cross-section, an area of a maximum foam cell is measured and is converted into a true-circle corresponding diameter, so that a maximum cell diameter is acquired. Then, foam cells having diameters which are not more than ½ of the maximum cell diameter are deleted as noise, and thereafter an average of cell diameters similarly converted from remaining cell areas is acquired and is used as the cell diameter.

Further, in this embodiment, the penetration amount (recessed amount ΔE in which the supplying roller 20 is recessed (depressed) by the developing roller 17) of the supplying roller 20 into the developing roller 17 was set at 1.0 mm.

4. Control Mode

Figure 3:
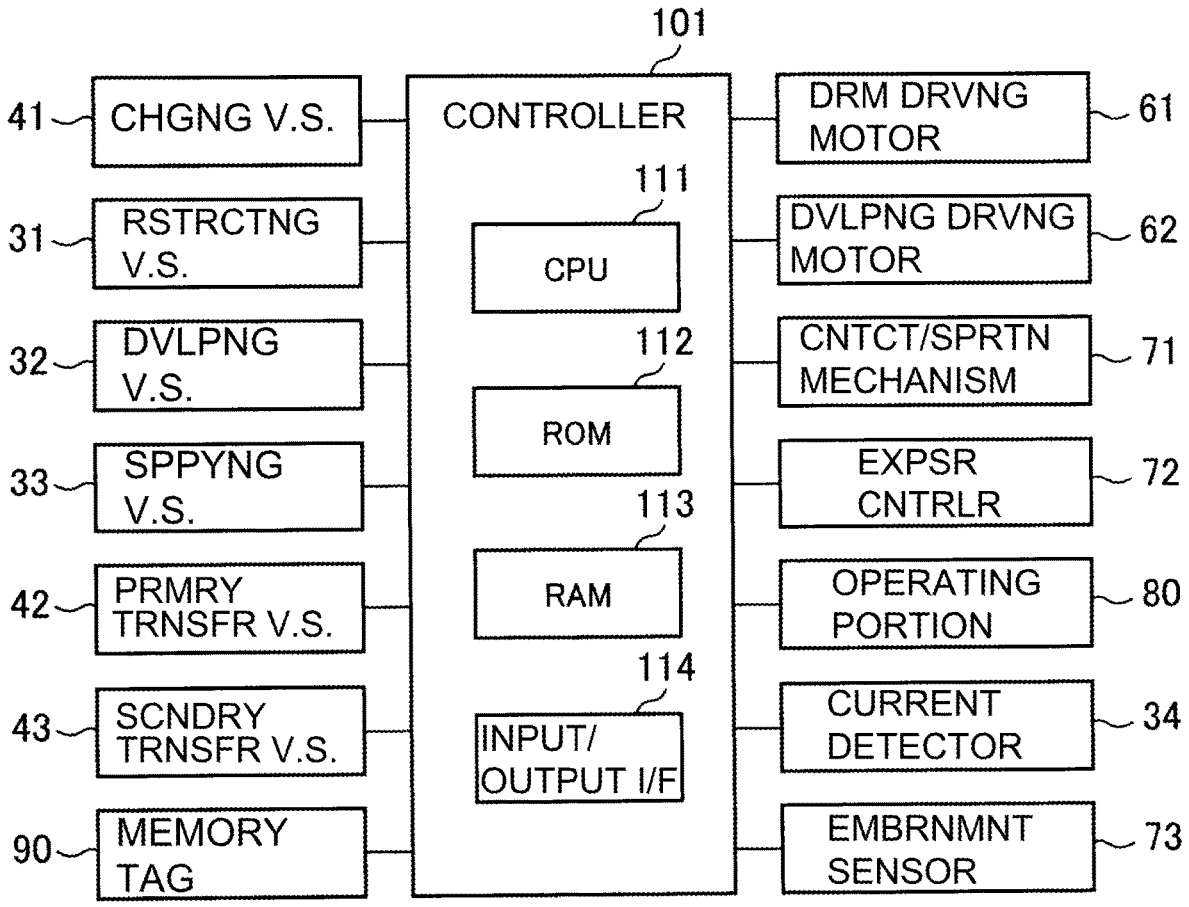
FIG. 3 is a schematic block diagram showing a control mode of a principal portion of the image forming apparatus.

FIG. 3 is a schematic block diagram showing a control mode of a principal portion of the image forming apparatus 100 of this embodiment. The image forming apparatus 100 includes a control portion (controller) 101 as a control means. The controller 101 includes a CPU (central processing unit) 111 which is a central element for performing processing (computation), memories such a ROM (including rewritable ROM) 112 and a RAM 113 which are storing means, and an input/output I/F 114 for permitting input and output of information with respect to peripheral devices. In the RAM 113, a detection result of a sensor and a calculation result and the like are stored, and in the ROM 112, a control program and data table acquired in advance and the like are stored.

The controller 101 controls operations of respective portions of the image forming apparatus 100 in an integrated manner. To the controller 101, objects to be controlled in the image forming apparatus 100 are connected via the input/output I/F 114. For example, to the controller 101, various high voltage sources such as the charging voltage source 41, the regulating voltage source 31, the developing voltage source 32, the supplying voltage source 33, the primary transfer voltage source 42 and the secondary transfer voltage source 43 are connected. Further, to the controller 101, various motors (power sources) such as the drum driving motor 61, the developing driving motor 62, a driving motor (not shown) for a polygon scanner as the exposure device and a belt driving motor (not shown) are connected. Further, to the controller 101, the contact and separation mechanism 71 for switching between contact and separation of the developing roller 17 relative to the photosensitive drum 1. Further, to the controller 101, an exposure controller 72 for transmitting, to the exposure device 3, a signal indicating a light quantity of the laser light with which the photosensitive drum 1 is irradiated is connected. Further, to the controller 101, an operating portion (operation panel) 80 provided on the image forming apparatus 100 is connected. The operating portion 80 includes a display portion as a display means for displaying information by control of the controller 101 and an input portion (keys and the like) as an input means for inputting, into the controller 101, pieces of information such as various settings of the image forming operation by an operator such as a user or a service person. Further, to the controller 101, a current detector (ammeter) 34 as a current detecting means for detecting the current flowing through the supplying roller 20 and for transmitting information (signal) on a detection result thereof to the controller 101 is connected. The image forming apparatus 100 includes an environment detecting means for detecting at least one of a temperature or a humidity of at least one of an inside and an outside of the apparatus main assembly 100A. In this embodiment, to the controller 101, as the environment detecting means, an environment sensor 73 capable of detecting a relative humidity of the inside of the apparatus main assembly 100A, specifically the relative humidity of an ambient environment of the developing unit 3 is connected. The environment sensor 73 transmits, to the controller 101, information (signal) on a detection result of the relative humidity of the ambient environment of the developing unit 23. In this embodiment, as described later, the detection result of the ambient humidity of the developing unit 23 by the environment sensor 73 is used for correcting the current detected by the contact detector 34, by the controller 101. Further, to the controller 101, in a state in which the cartridge 7 is mounted in the apparatus main assembly 100A, a memory tag 90 as a storing means provided on the cartridge 7 is connected. The memory tag 90 can be provided on at least one of the accommodating unit 24, the developing unit 23 and the photosensitive member unit 13 and may also be provided on each of these units. The controller 101 is capable of reading and writing information relative to the memory tag 90. The respective objects to be controlled including these examples are operated on the basis of control signals from the controller 101.

5. Measuring Method of Current Flowing Through Supplying Roller

Next, a measuring method of the current flowing through the supplying roller 20 will be described.

As shown in FIG. 2, in this embodiment, to the supplying roller 20, the current detector (ammeter) 23 is connected in series. When the current flowing through the supplying roller 20 is detected by the current detector 34, it is preferable that the potential difference between the developing roller 17 and the supplying roller 20 is made a predetermined value or less. Specifically, the detection of the current is executed in a state in which a voltage at which the potential difference between the developing roller 17 and the supplying roller 20 is a predetermined value or less is applied to either one or both of the developing roller 17 and the supplying roller 20. Or, the current detection is executed in a state in which the voltage is not applied to both the developing roller 17 and the supplying roller 20. Typically, when the current flowing through the supplying roller 20 is detected, the developing roller 17 and the supplying roller 20 are made the substantially same potential. Specifically, the current detection is executed in a state in which the voltage is not applied to both the developing roller 17 and the supplying roller 20 (i.e., in a state in which both the developing roller 17 and the supplying roller 20 are connected to the ground (potential)) so that the developing roller 17 and the supplying roller 20 have the substantially same potential. Or, the current detection may also be executed in a state in which a voltage at which the developing roller 17 and the supplying roller 20 have the substantially same potential is applied to either one or both of the developing roller 17 and the supplying roller 20.

Parts (a) and (b) of FIG. 4 are schematic circuit views of portions relating to the developing roller 17 and the supplying roller 20. In a state in which the developing roller 17 and the supplying roller 20 are not rotated (at rest) (part (a) of FIG. 4), the toner layer functions as an insulating material, so that the current does not flow even when the potential difference is provided between the developing roller 17 and the supplying roller 20. On the other hand, when the developing roller 17 and the supplying roller 20 are rotated and the toner with electric charge moves between the developing roller 177 and the supplying roller 20, the toner functions as a current source, so that the current flows (part (b) of FIG. 4). By detecting this current value, a surface potential of the layer of the toner coated on the developing roller 17 is estimated as described later, so that a deteriorated state (deterioration degree) of the developing roller 17 can be predicted. However, when the potential difference between the developing roller 17 and the supplying roller 20 is large, the current flowing between the developing roller 17 and the supplying roller 20 is influenced by an electric resistance of the developing roller 17 and an electric resistance of the supplying roller 20. That is, when the potential difference larger than a predetermined value is provided between the developing roller 17 and the supplying roller 20, a current detection result varies depending on the electric resistances of the developing roller 17 and the supplying roller 20. For that reason, as described later, it is not readily understood as to whether the current value is changed due to a difference in deteriorated state of the developing roller 17 or due to a fluctuation in electric resistance values of the developing roller 17 and the supplying roller 20. Accordingly, when the current flowing through the supplying roller 20 is detected, the potential difference between the developing roller 17 and the supplying roller 20 may preferably be made small to the extent possible. According to study by the present inventors, the potential difference between the developing roller 17 and the supplying roller 20 when the current flowing through the supplying roller 20 is detected may preferably be 50 V or less, more preferably be substantially 0 V (the same potential). Here, the potential difference between the developing roller 17 and the supplying roller 20 is represented by a potential difference between the developing bias and the supplying bias.

Incidentally, in part (b) of FIG. 4, the state in which the voltage is not applied to both the developing roller 17 and the supplying roller 20 corresponds to a state in which the developing roller 17 is connected to the ground without via a battery Vdr and the supplying roller 20 is connected to the ground without via a battery Vrs but is connected to the ground via the current detector (detecting portion) 34. Further, in the case where the voltage is applied to at least one of the developing roller 17 and the supplying roller 20, a current obtained by superposing a current due to toner movement on a current flowing depending on the applied voltage and the electric resistances of the developing roller 17 and the supplying roller 20 is detected by the current detector 34. Further, even in a state in which the voltage is not applied to both the developing roller 17 and the supplying roller 20, depending on a circuit structure of the developing voltage source 32 and the supplying voltage source 33, the case where the potential difference between the developing roller 17 and the supplying roller 20 is formed would be considered. In that case, for example, the voltages may be applied to the developing roller 17 and the supplying roller 20 so that the developing roller 17 and the supplying roller 20 have the substantially same potential, and when the potential difference between the developing roller 17 and the supplying roller 20 is 50 V or less, a state in which no voltage is applied to the rollers may also be formed.

Further, when the current flowing through the supplying roller 20 is detected by the current detector 34, the potential difference between the developing blade 21 and the developing roller 17 may preferably be made a potential difference substantially equal to the potential difference during the image formation. Specifically, the current detection may preferably be executed in a state in which a voltage at which the potential difference between the developing blade 21 and the developing roller 17 is substantially equal to the potential difference during the image formation is applied to the developing blade 21. This is because the charge amount of the toner coated on the developing roller 17 changes depending on the potential difference between the developing blade 21 and the developing roller 17. In this embodiment, when the current flowing through the supplying roller 20 is detected, in order that the potential difference between the developing blade 21 and the developing roller 17 is made 100 V which is substantially equal to the potential difference during the image formation, a regulating bias Vbl=−100 V was set. Incidentally, similarly as during the image formation, the potential difference between the developing blade 21 and the developing roller 17 may preferably be 500 V or less. This is because as described above, when the potential difference is made excessively large, electric discharge generates between the developing blade 21 and the developing roller 17. Here, the potential difference between the developing blade 21 and the developing roller 17 is represented by the potential difference between the regulating bias and the developing bias.

Incidentally, "substantially equal" for the potential and the potential difference not only includes the case where the potentials or the potential differences are completely equal to each other but also includes the case where the potentials or the potential differences are different from each other approximately within an allowable error (for example, about ±5%).

Next, with reference to FIG. 5, a sequence of a current detecting operation for detecting the current flowing through the supplying roller 20 in this embodiment will be described. FIG. 5 is a timing chart showing operation timing of respective portions during the image forming operation and during the current detecting operation. In this embodiment, the current detecting operation is performed after the image forming operation, i.e., performed during non-image-formation. First, the controller 101 starts application of the charging bias to the charging roller 2 and drive of the photosensitive drum 1 substantially at the same time in order to perform the image forming operation when an instruction to start the image forming operation is inputted (t1). Thereafter, the controller 101 starts, substantially at the same time, application of the regulating bias to the developing blade 21, application of the developing bias to the developing roller 17, application of the supplying bias to the supplying roller 20 and drive of the developing roller 17 and the supplying roller 20 (t2). Thereafter, the controller 101 causes the developing roller 17 to contact the photosensitive drum 1 at timing when a peripheral speed of the developing roller 17 reaches a predetermined peripheral speed (process speed) and thus starts the image forming operation (t3).

When the image forming operation is ended, the controller 101 causes the developing roller 17 to separate from the photosensitive drum 1 (t4). Thereafter, the controller 101 stops, substantially at the same time, the application of the developing bias to the developing roller 17, the application of the supplying bias to the supplying roller 20, the application of the charging bias to the charging roller 2 and the drive of the photosensitive drum 1 (t5). Here, at the timing t5, the controller 101 also carries out adjustment of the regulating bias to be applied to the developing blade 21 so that the potential difference between the developing blade 21 and the developing roller 17 is substantially the same (about 100 V) as the potential difference during the image formation, while continuing the drive of the developing roller 17 and the supplying roller 20. In this embodiment, the regulating bias is changed from −400 V to −100 V. Then, in that state, the controller 101 acquires a detection result of the current, flowing through the supplying roller 20, by the current detector 34 (t5 to t6). Incidentally, the detection result of the current flowing through the supplying roller 20 can be represented by an average of current values detected in a predetermined period. Thereafter, when the detection of the current flowing through the supplying roller 20 by the current detector 34 is ended, the controller 101 stops the drive of the developing roller 17 and the supplying roller 20 (t6). Thereafter, the controller 101 stops the application of the regulating bias to the developing blade 21 (t7).

Incidentally, in this embodiment, the detecting operation of the current flowing through the supplying roller 20 is executed after the image forming operation is ended and before the operation of the image forming apparatus 100 is stopped (before the stand-by state), but the present invention is not limited thereto. For example, the current detecting operation may also be executed after the instruction to start the image forming operation is inputted and before the image forming operation is started or executed in a period corresponding to a feeding interval between the recording material P and a subsequent recording material during the image forming operation (i.e., a sheet interval). Further, the current detecting operation may also be executed during a preparatory operation after a main switch of the image forming apparatus 100 is turned on or during a preparatory operation after the image forming apparatus 100 is restored from a sleep state. Further, in this embodiment, in order to improve detection accuracy of the current flowing through the supplying roller 20, setting of the developing bias and the supplying bias during the current detection was made different from the setting thereof during the image formation. However, in the case where the current can be detected with desired accuracy in the setting during the image formation, the current detection may also be carried out during the image formation. In that case, the developing roller 17 may be contacted to the photosensitive drum 1.

6. Notification of (End of) Lifetime of Developing Unit

<Outline of Notification of Lifetime of Developing Unit>

In this embodiment, on the basis of the detection result of the current flowing through the supplying roller 20, the controller 101 executes a process for correcting timing of notifying information on (an end of) lifetime of the developing unit 23 which is the unit including the developing roller 17. That is, in this embodiment, the current flowing through the supplying roller 20 is detected as an index indicating the deteriorated state of the developing roller 17, and on the basis of a detection result thereof, timing of notifying the information on the (end of) lifetime of the developing unit 23 is corrected. By this, in this embodiment, the information on the lifetime (typically the end of lifetime) of the developing unit 23 is notified at more appropriate timing when an actually deteriorated state of the developing roller 17 is reflected.

<Correction Coefficient Setting Operation>

FIG. 6 is a flowchart showing an outline of a procedure of a correction coefficient setting operation in which correction coefficient for acquiring a remaining lifetime amount of the developing unit 23 in this embodiment is set.

The controller 101 starts control of the correction coefficient setting operation when insertion and extraction of the cartridge 7 relative to the apparatus main assembly 100A is carried out (S101). The insertion and extraction of the cartridge is discriminated by the controller 101 on the basis of a detection result (signal) of a sensor (not shown) for detecting opening/closing of a door of the apparatus main assembly 100A through which the insertion and extraction of the cartridge 7 is carried out.

Next, the controller 101 discriminates whether or not the toner accommodating unit 24 is a fresh article (S102). Incidentally, the fresh article of the toner accommodating unit 24 can be discriminated on the basis of information in the memory tag 90 (FIG. 3) provided on the cartridge. In this case, it is possible to discriminate that the toner accommodating unit 24 is the fresh article by either one of that predetermined information indicating the fresh toner accommodating unit 24 is stored in the memory tag 90 and that predetermined information not indicating the fresh toner accommodating unit 24 is not stored in the memory tag 90. Further, the fresh toner accommodating unit 24 may also be discriminated on the basis of information, indicating that the toner accommodating unit 24 is the fresh article, inputted by the operator through the operating portion 80 or an external device communicatably connected to the image forming apparatus 100 (i.e., on the basis of information indicating that the toner accommodating unit 24 is exchanged or the like information).

Next, in the case where the toner accommodating unit 24 is discriminated as being the fresh article in S102, the controller 101 discriminates whether or not the developing unit 23 is a fresh article (S103). In S103, the case where the developing unit 23 is discriminated as being the fresh article is the case where both the toner accommodating unit 24 and the developing unit 23 are the fresh articles. Incidentally, whether or not the developing unit 23 is the fresh article can be discriminated by a method similar to the method in the case where whether or not the toner accommodating unit 24 is the fresh article is discriminated.

Then, in the case where the controller 101 discriminates in S103 that the developing unit 23 (i.e., the developing unit 23 and the toner accommodating unit 24) is the fresh article, the following process is performed. That is, after use of the fresh developing unit 23 and the fresh toner accommodating unit 24 is started, a travel distance of the developing roller 17 reaches a predetermined travel distance (S104), and then the current detecting operation for detecting the current flowing through the supplying roller 20 is executed (S105). At this time, the controller 101 controls the developing voltage source 32 and the supplying voltage source 33, so that a potential difference between the developing roller 17 and the supplying roller 20 is used as a current detecting potential difference. In this embodiment, application of the bias from the developing voltage source 32 to the developing roller 17 and application of the bias from the supplying voltage source 33 to the supplying roller 20 are turned off (i.e., the developing roller 17 and the supplying roller 20 are connected to the ground), so that the potentials of the developing roller 17 and the supplying roller 20 are made substantially the same. That is, in this embodiment, the above-described current detecting potential difference is substantially 0 V. Further, the controller 101 acquires a detection result of an ambient humidity of the developing unit 23 by the environment sensor 73 during the current detecting operation in order to correct the current detection result (S106).

Here, the controller 101 acquires the travel distance of the developing roller 17 in the image forming operation by converting the travel distance into an image output sheet number with respect to predetermined size-recording materials P, and causes the ROM 112 (or the memory tag 90) to sequentially store the image output sheet number. In this embodiment, timing when the current flowing through the supplying roller 20 is set at timing after the images are outputted on 50 sheets in total after the use of the fresh toner accommodating unit 24 is started. In the case where the total of the image output sheet number reaches 50 sheets during the image forming operation in which the images are successively formed on a plurality of recording materials P, the image forming operation is interrupted, and then the current detecting operation can be performed. Or, depending on the remaining image output sheet number in the image forming operation (for example, in the case where the remaining image output sheet number is relatively small), the current detecting operation may also be carried out after the image forming operation is ended. This timing of detecting the contact flowing through the supplying roller 20 is not limited to timing corresponding to timing after the image output sheet number reaches 50 sheets. This timing can be appropriately set when the timing is initial use timing when deterioration of fresh toner is small to a negligible degree after the use of the fresh toner accommodating unit 24 is started and then a charge amount of the toner newly carried on the developing roller 17 is sufficiently stabilized. For example, as in this embodiment, when lifetime setting of the toner accommodating unit 24 is 5000 sheets in terms of the image output sheet number, the timing of the image output sheet number of 25 sheets to 100 sheets, preferably about 50 sheets serves as a measure. That is, timing such that the toner is consumed from the fresh toner accommodating unit 24 in an amount corresponding to about 0.5% to 2%, preferably about 1% of lifetime setting (image output sheet number or the like) of the toner accommodating unit 24 serves as the measure. Incidentally, an index value correlating with the use amount of the developing roller 17 is not limited to the travel distance (image output sheet number), but may also be the number of rotations, a rotation time and the like of the developing roller 17.

Then, on the basis of information indicating a relationship between a relative humidity and a current value stored in the ROM 112, the controller 101 converts the current value acquired in S105 into a current value when the relative humidity is 50% RH (S107). Thereafter, the controller 101 causes the ROM 112 to store the converted current value as an initial current value (initial value) (S108). Then, the controller 101 ends the process of the correction coefficient setting operation (S114). In this embodiment, the information indicating the relationship between the relative humidity and the current value used in S107 (and S112 described later) is set in advance and is stored as table data in the ROM 112. The current value conversion in S107 (and S112) will be described later further specifically.

In the case where the controller 101 discriminates that the developing unit 23 is not the fresh article in S103, the controller 101 performs processes S109 to S112 which are processes similar to S104 to S107, respectively. By this, the controller 101 acquires a detection result of the current flowing through the supplying roller 20 converted into the current value when the relative humidity is 50% RH. Incidentally, the case where the developing unit 23 is discriminated as being not the fresh article in S103 is the case where the developing unit 23 is not the fresh article but the toner accommodating unit 24 is the fresh article (i.e., in the developing unit 4, only the toner accommodating unit 24 is exchanged).

Thereafter, on the basis of a difference (change amount from the initial value) between the initial current value stored in S108 and the current value acquired in S112, the controller 101 makes setting of the correction coefficient for acquiring the remaining lifetime amount of the developing unit 23 (S113). Then, the controller 101 causes the ROM 112 to store the set correction coefficient. Then, the controller 101 ends the process of the correction coefficient setting operation (S114). Incidentally, a method of acquiring the remaining lifetime amount of the developing unit 23 and the correction coefficient setting will be described later further specifically.

In the case where the controller 101 discriminates that the toner accommodating unit 24 is not the fresh article in S102, the controller 101 ends the process of the correction coefficient setting operation without performing the subsequent process (S114).

<Operation Procedure of Lifetime Notification of Device>

FIG. 7 is a flowchart showing an outline of a procedure of an operation of notifying the (end of) lifetime of the developing unit 23. When an instruction to start the image forming operation is inputted (S201), the controller 101 causes the image forming apparatus 100 to start the image forming operation (S202). The controller 101 acquires the travel distance of the developing roller 17 in the image forming operation into the image output sheet number with respect to the predetermined size-recording materials P (S203). Further, the controller 101 reads the information on the correction coefficient stored in the ROM 112 and information on a decrease amount (decrease rate) of the remaining lifetime amount of the developing unit 23 per unit travel distance of the developing roller 17 (S204). As will be described later specifically in this embodiment, the remaining lifetime amount decrease rate is set at 100%/20000 sheets. Next, on the basis of the travel distance of the developing roller 17 acquired in S203 and the correction coefficient and the remaining lifetime amount decrease rate which are read in S204, the controller 101 acquires a remaining lifetime amount decrease amount of the developing unit 23 corresponding to the travel distance of the developing roller 17 acquired in S203 (S205). That is, the controller 101 acquires the remaining lifetime amount decrease amount by multiplying the travel distance of the developing roller 17 acquired in S203, the remaining lifetime amount decrease amount and the correction coefficient. Then, the controller 101 acquires the latest remaining lifetime amount of the developing unit 23 by subtracting the remaining lifetime amount decrease amount acquired in S205 from the remaining lifetime amount of the developing unit 23 acquired and stored in the ROM 112 until then, and causes the ROM 112 to store the latent remaining lifetime amount (S206). Next, the controller 101 discriminates whether or not the latest remaining lifetime amount of the developing unit 23 acquired in S206 reaches 0% which is a predetermined value (threshold) corresponding to the end of the lifetime (S207).

Then, in the case where the controller 101 discriminates in S207 that the remaining lifetime amount of the developing unit 23 reaches 0% (i.e., the developing unit 23 reaches the end of the lifetime thereof), the controller 101 causes the operating portion 80 to display that the developing unit 23 reaches the end of the lifetime thereof (S208). Thereafter, the controller 101 causes the image forming apparatus 100 to end and the operation thereof after a predetermined operation after the image forming operation is executed. Further, in the case where the controller 101 discriminates in S207 that the remaining lifetime amount of the developing unit 23 does not reach 0%, the controller 101 discriminates whether or not output of all the images designated in the instruction to start the image forming operation is ended (S209). Thereafter, in the case where the output of all the images is not ended, the controller 101 returns the process to S202, and in the case where the output of all the images is ended, the controller 101 causes the image forming apparatus 100 to end the operation thereof after the predetermined operation after the image forming operation is executed.

Here, in this embodiment, in addition to the acquirement of the remaining lifetime amount of the developing unit 23, the controller 101 is constituted so as to acquire a remaining lifetime amount of the toner accommodating unit 24 by detecting a remaining amount of the toner in the toner accommodating chamber 18*b*. As a remaining amount detecting means for detecting the remaining amount of the toner, it is possible to use means of any known types such as an optical detection type, and electrostatic capacity detection type and a type based on the image information (video count type). In this embodiment, on the basis of a detection result of the remaining amount detecting means, the controller 101 sequentially acquires the remaining lifetime amount of the toner accommodating unit 24 when the remaining lifetime amount in a fresh state of the toner accommodating unit 24 is a remaining lifetime amount of 100% and the remaining lifetime amount in a state in which the amount of the toner decreases to a degree such that exchange of the toner accommodating unit 24 is desired is a remaining lifetime amount of 0%, and thus renews the remaining lifetime amount and causes the ROM 112 to store the renewed remaining lifetime amount. Then, in the case where the remaining lifetime amount of the toner accommodating unit 24 reaches 0% which is a predetermined amount (threshold) corresponding to the end of the lifetime of the toner accommodating unit 24, the controller 101 causes the operating portion 80 to display that the toner accommodating unit 24 reaches the end of the lifetime thereof.

Incidentally, notification of the information on the lifetime of the unit (developing unit 23, toner accommodating unit 24) is not limited to the display at the operating portion 80 provided on the image forming apparatus 100. For example, the display may also be made at a display portion of an external device such as a personal computer connected to the image forming apparatus 100. In this case, the controller 101 sends, to the external device, information (signal) for notifying the information on the (end of) the lifetime. Further, as the information on the lifetime, it is possible to notify information indicating that the unit reaches the end of the lifetime thereof and information prompting the operator to exchange the unit. Further, the notification is not limited to the notification by the display, but may also be notification by any method such as notification by voice including a message, warning or the like of contents similar to the above-described display contents, or notification by light such as turning on or flickering of a lamp. Further, a plurality of thresholds are set for the remaining lifetime amount, and for example, in the case where the remaining lifetime amount is not more than a first threshold (and is larger than a second threshold smaller than the first threshold, it is possible to notify the information prompting the operator to exchange the unit. The remaining lifetime amount may also be displayed sequentially and automatically or in response to an instruction from the operator.

Further, in this embodiment, the toner accommodating chamber 18*b* is mountable and dismountable (exchangeable) as the toner accommodating unit 24 relative to the developing unit 23.

However, the present invention is not limited thereto, and in the case where the amount of the toner accommodated inside the toner accommodating chamber 18*b* is not more than a predetermined amount (typically substantially zero), fresh toner may be replenished into the toner accommodating chamber 18*b*. That is, a constitution in which the toner accommodating chamber 18*b* itself is not exchange but the toner there is exchange with the fresh toner may also be employed. In this case, most of the toner in the toner accommodating chamber 18*b* after the fresh toner is replenished, for example, 90% (weight amount basis) or more of the toner is the fresh toner, it is possible to regard the toner in the toner accommodating chamber 18*b* as being exchange with the fresh toner.

Further, in the case where the unit reaches the end of lifetime, in addition to perform notification to that effect, the image forming operation may also be prohibited until a process such as the exchange of the unit is performed.

Further, the information such as the correction coefficient and the remaining lifetime amount which are stored in the above-described ROM 112 may also be stored in the memory tag 90 provided on the cartridge 7.

<Principle of Correction of Remaining Lifetime Amount of Developing Unit>

FIG. 8 is a graph showing an example of a result of repetitive measurement of a surface potential of the toner layer coated on the developing roller 17 when the toner accommodating unit 24 is exchange every 5000 sheets in terms of the image output sheet number and then images are outputted on 50 sheets (i.e., in a state in which the toner is close to a fresh toner. That is, FIG. 8 shows a change in surface potential of the toner layer on the developing roller 17 on which the toner in a state in which the toner accommodating unit 24 is exchange and the toner close to the fresh state is coated. In this case, the image forming operation was carried out with an image ratio in which the toner in the toner accommodating chamber 18*b* decreases to a degree such that the exchange of the toner accommodating chamber 24 is needed by the output of the images on the 5000 sheets. Incidentally, the surface potential of the toner layer coated on the developing roller 17 (in other words, the surface potential of the developing roller 17 on which the toner is coated) can be measured using various known measuring devices (electromotors).

From FIG. 8, it is understood that with an increase in use amount of the developing unit 23 (developing roller 17), the surface potential of the toner layer changes to the positive side. This is due to a decrease in charge amount per unit area (Q/S) of the negatively chargeable toner coated on the developing roller 17 with progress of the deterioration of the developing roller 17 by the image forming operation.

FIG. 9 is a graph showing an example of a relationship between the toner layer surface potential and the current flowing through the supplying roller 20 measured by rotating the supplying roller 20 and the developing roller 17 in a state in which these rollers are connected to the ground (ground potential) and the potentials thereof are made substantially the same. It is understood that when the toner layer surface potential changes to the positive side, the current flowing through the supplying roller 20 changes to the positive side. That is, when an absolute value of the negative toner layer surface potential increases, an absolute value of the negative current flowing through the supplying roller 20 increases. In this embodiment, the toner as negatively charged particles moves from the developing roller 17 to the supplying roller 20 side, so that the current flowing through the supplying roller is represented by the negative(-polarity) current. This is for the following reason. That is, when the toner layer surface potential changes in the positive direction, i.e., when the charge amount of the negative toner becomes small, the charge amount of the negative toner peeled off of the developing roller 17 by the supplying roller 20 becomes small. This is because due to the decreased charge amount, the absolute value of the negative current generated by peeling off of the toner from the developing roller 17 by the toner becomes small.

Accordingly, in a state in which the toner after the exchange of the toner accommodating unit 24 is close to the fresh article (in a state in which the influence of toner deterioration on the current flowing through the supplying roller 20 is relatively small), the contact flowing through the supplying roller 20 is detected. By this, a state in which the charge amount per unit area is decreased by a lowering in charge imparting power to the toner due to the deterioration of the developing roller 17 can be grasped from the current flowing through the supplying roller 20. Thus, the lowering in charge imparting power to the toner, which is the deterioration state of the developing roller 17 can be grasped by the measurement, so that the end of the lifetime of the developing unit 23 can be discriminated more appropriately. In this embodiment, an allowable level of a "fog" (image) density on the recording material P was set at 5%. Further, lifetime notification timing is set so that in the case where the contact flowing through the supplying roller 20 in a state in which the toner after the exchange of the toner accommodating unit 24 is close to the fresh article changes from an initial value (the above-described initial current value by 0.81 μA, notification that the developing unit 23 reaches the end of the lifetime thereof is provided. This is because in the case where the change amount of the current flowing through the supplying roller 20 from the initial value exceeds 0.81 μA, the "fog" density on the recording material P exceeds 5% according to study made in advance.

Here, a constitution in which as in this embodiment, the developing roller 17 and the supplying roller 20 rotate so that their surfaces move in the same direction at a contact portion therebetween is referred to as "the same direction peeling-off constitution". On the other hand, a constitution in which the developing roller 17 and the supplying roller 20 rotate so that their surfaces move in the opposite directions at the contact portion therebetween is referred to as "the opposite direction peeling-off constitution". Compared with "the opposite direction peeling-off constitution", "the same direction peeling-off constitution" is low in toner peeling-off power from the developing roller 17 by the supplying roller 20. For that reason, in "the same direction peeling-off constitution", the toner remaining on the developing roller 17 without being peeled off by the supplying roller 20 is liable to repetitively passes through the contact portion between the developing roller 17 and the developing blade 21. Then, the same toner on the developing roller 17 repetitively passes through the contact portion between the developing roller 17 and the developing blade 21, so that the toner layer surface potential on the developing roller 17 is liable to cause a difference every charge imparting power depending on the deteriorated state of the developing roller 17. On the other hand, in "the opposite direction peeling-off constitution", compared with "the same direction peeling-off constitution", the toner peeling-off power by the supplying roller 20 is high, so that typically, the toner on the developing roller 17 is substantially entirely peeled off when the toner passes once through the contact portion between the developing roller 17 and the supplying roller 20. For that reason, in "the opposite direction peeling-off constitution", irrespective of a difference in deteriorated state of the developing roller 17, the toner layer surface potential on the developing roller 17 readily becomes substantially constant. Thus, compared with "the opposite direction peeling-off constitution", in "the same direction peeling-off constitution", there is a tendency that a correlation between the deteriorated state of the developing roller 17 and the toner layer surface potential becomes high, so that a correlation between the deteriorated state of the developing roller 17 and the current flowing through the supplying roller 20 becomes high. That is, in "the same direction peeling-off constitution", the change in current flowing through the supplying roller 20, in a period from a start of use of the developing unit 23 until the developing unit 23 reaches the end of the lifetime thereof, measured in the state in which the toner is close to the fresh toner is larger than the change in the current flowing through the supplying roller 20 in "the opposite direction peeling-off constitution". For that reason, it can be said that "the same direction peeling-off constitution" is more suitable constitution than "the opposite direction peeling-off constitution" in that the degree of deterioration of the developing roller 17 is predicted on the basis of the detection result of the current flowing through the supplying roller 20.

Incidentally, the "fog" density of the recording material P can be represented by a difference (density difference (%)) between a result of measurement of reflection density of a white background portion where a predetermined image (solid white image or the like) is formed on a predetermined recording material (paper) P and a result of measurement of reflection density of the recording material P of the same kind.

Here, a peripheral speed difference of the supplying roller 20 relative to the developing roller 17 may preferably be set in a range of 120% to 230%. In the case where the peripheral speed difference is smaller than 120%, the amount of the toner peeled off of the developing roller 17 by the supplying roller decreases, so that the change in current flowing through the supplying roller 20 due to the deteriorated state of the developing roller 17 becomes small. As a result, there is a possibility that discrimination accuracy of the lifetime of the developing unit 23 based on the detection result of the current lowers. On the other hand, in the case where the peripheral speed difference is larger than 230%, substantially all the toner on the developing roller 17 is peeled off by the supplying roller 20 in some instances. For that reason, the change in current flowing through the supplying roller 20 due to the deteriorated state of the developing roller 17 becomes small. As a result, there is also a possibility that the discrimination accuracy of the lifetime of the developing unit 23 based on the detection result of the current lowers.

<Correction of Remaining Lifetime Amount>

FIG. 10 is a graph showing an example of a result of measurement in which the current flowing through the supplying roller 20 is repetitively measured when the toner accommodating unit 24 is exchange every 5000 sheets in terms of the image output sheet number and then images are outputted on 50 sheets (i.e., in a state in which the toner is close to the fresh article). That is, FIG. 10 shows a change in current flowing through the supplying roller 20 in the state in which the toner after the toner accommodating unit 24 is exchange is close to the fresh toner. From FIG. 10, it is understood that with increasing use amount of the developing unit 23 (developing roller 17) the current flowing through the supplying roller 20 changes in the positive direction. This represents that the charge amount per unit area is decreased by a lowering in charge imparting power to the toner due to the deterioration of the developing roller 17.

FIG. 11 is a graph showing an example of a change in remaining lifetime amount of the developing unit 23 (developing roller 17) relative to an increase in use amount of the developing unit 23 (developing roller 17). In FIG. 11, a broken line represents the change in remaining lifetime amount of the developing unit 23 predicted only from the travel distance (image output sheet number) of the developing roller 17. Further, a table 1 below shows a relationship between the travel distance (image output sheet number) of the developing roller 17 and the remaining lifetime amount of the developing unit 23 in the change (progression) indicated by the broken line of FIG. 11. As shown in the table 1, depending on the travel distance of the developing roller 17, the remaining lifetime amount changes from 100% to 0%.

TABLE 1

| IOSN*1 (sheets) | RLA(P)*2 (%) | CCA(P)*3 (μA) |
|---|---|---|
| 0 | 100 | 0.00 |
| 5000 | 75 | 0.20 |
| 10000 | 50 | 0.41 |

TABLE 1-continued

| IOSN*1 (sheets) | RLA(P)*2 (%) | CCA(P)*3 (μA) |
|---|---|---|
| 15000 | 25 | 0.61 |
| 20000 | 0 | 0.81 |

*1"IOSN" is the image output sheet number.
*2"RLA(P)" is the remaining lifetime amount (predicted of the developing unit 23.
*3"CCA(P)"is the current change amount (predicted) from the initial value.

In the constitution of this embodiment, in the case where lifetime notification of the developing unit 23 is carried out from only the travel distance of the developing roller 17, the notification of the end of the lifetime is provided at the image output sheet number of 20000 sheets. That is, the deteriorated state of the developing roller 17 is predicted depending on the image output sheet number on the assumption that the remaining lifetime amount of the developing unit 23 becomes 0% when the image output sheet number is 20000 sheets. Accordingly, as shown in table 1, the remaining lifetime amount of the developing unit 23 is predicted on the assumption that the change amount, from the initial value, of the current flowing through the supplying roller 20 becomes 0.81 μA when the image output sheet number is 20000 sheets. However, the reason why such prediction is made is that setting is made so that a problem such as an image defect (for example, the "fog" density exceeding 5%) does not occurs before the remaining lifetime amount reaches 0%, even under a relatively severe use (operation) condition in consideration of various use (operation) conditions. That is, depending on the use condition, even after timing when the end of the lifetime is notified depending on such prediction, the developing unit 23 can be used in some instances without causing the problem such as the image defect.

Therefore, in this embodiment, on the basis of the detection result of the current flowing through the supplying roller 20, an actually detected state of the developing unit 23 is grasped. Further, when the developing unit 23 is capable of being used in a period exceeding the lifetime predicted from only the travel distance of the developing roller 17, the remaining lifetime amount of the developing unit 23 is corrected so that timing of the notification of the end of the lifetime is delayed and is made proper timing.

A solid line of FIG. 11 shows a change in actual remaining lifetime amount of the developing unit 23 converted on the basis of an actual measurement result of the current flowing through the supplying roller 20. Further, a table 2 below shows a relationship between the travel distance (image output sheet number) of the developing roller 17, the remaining lifetime amount of the developing unit 23 and the change amount, from an initial value, of the current flowing through the supplying roller 20, in the change (progression) indicated by the solid line of FIG. 11.

TABLE 2

| IOSN*2 (SHEETS) | COLUMN a CV*2 (μA) | COLUMN b CCA*3 (μA) | COLUMN c RLA(AM)*4 (%) |
|---|---|---|---|
| 0 | −0.47 | 0.00 | 100.0 |
| 5000 | −0.30 | 0.17 | 79.0 |
| 10000 | −0.14 | 0.33 | 59.3 |
| 15000 | 0.00 | 0.47 | 42.0 |

TABLE 2-continued

| IOSN*2 (SHEETS) | COLUMN a CV*2 (μA) | COLUMN b CCA*3 (μA) | COLUMN c RLA(AM)*4 (%) |
|---|---|---|---|
| 20000 | 0.12 | 0.59 | 27.2 |
| 25000 | 0.25 | 0.72 | 11.1 |
| 30000 | 0.34 | 0.81 | 0.0 |

*1"IOSN" is the image output sheet number.
*2"CV" is the current value.
*3"CCA" is the current change amount from the initial value.
*4"RLA(AM)" is the remaining lifetime amount (actually measured) of the developing unit 23.

A column a in the table 2 shows the current flowing through the supplying roller 20 actually measured in the state in which the toner after the toner accommodating unit 24 is exchange is close to the fresh toner. A column b in the table 2 shows the change amount of the current from the initial value. As regards the remaining lifetime amount of the developing unit 23, the case where a change amount of the actually measured current from the initial value is 0 μA is taken as 100% and the case where the change amount is 0.81 μA is taken as 0%. A column c in the table 2 shows the remaining lifetime amount (%) of the developing unit 23.

In this embodiment, on the basis of a difference between the remaining lifetime amount (broken line of FIG. 11) predicted from the travel distance and the remaining lifetime amount (solid line of FIG. 11) depending on the actually deteriorated state of the developing roller 17, progression of the remaining lifetime amount is corrected. By this, timing when the end of the lifetime of the developing unit 23 is notified is made proper timing. An arrow line of FIG. 11 shows the change (progression) of the remaining lifetime amount of the device 23 after the correction. A correction method will be described further specifically using a table 3.

TABLE 3

| IOSN*1 (SHEETS) | CL · b CCA*2 (μA) | CL · d CCAD (AM)*3 (μA) | CL · e CCAD (P)*4 (μA) | CL · f CC*5 | CL · g PCA*6 (μA) | CL · h RLA (AC)*7 (μA) |
|---|---|---|---|---|---|---|
| 0 | 0 | — | — | 1.00 | 0.00 | 100.0 |
| 5000 | 0.17 | 0.17 | 0.20 | 0.84 | 0.20 | 75.3 |
| 10000 | 0.33 | 0.16 | 0.20 | 0.79 | 0.37 | 54.3 |
| 15000 | 0.47 | 0.14 | 0.20 | 0.69 | 0.50 | 38.5 |
| 20000 | 0.59 | 0.12 | 0.20 | 0.59 | 0.67 | 17.6 |
| 25000 | 0.72 | 0.13 | 0.20 | 0.64 | 0.77 | 4.9 |
| 30000 | 0.81 | 0.09 | 0.20 | — | 0.90 | — |

*1: "IOSN" is the image output sheet number.
*2: "CCA" is the current change amount from the initial value.
*3: "CCAD(AM)" is the current change amount difference (actually measured).
*4: "CCAD(P)" is the current change amount difference (predicted).
*5: "CC" is the correction coefficient.
*6: "PCA" is the predicted current amount after the correction.
*7: "RLA(AC)" is the remaining lifetime amount (after correction) of the developing unit 23.

A column b in the table 3 is the same as the column b in the table 2 and shows the change amount, from the initial value, of the above-described actually measured current. A column d in the table 3 shows a value obtained by correcting the value of the column b to a current change amount for each exchange of the toner accommodating unit 24. A column e in the table 3 shows a predicted value of the current change amount for each exchange of the toner accommodating unit 24 in the case where the remaining lifetime amount of the developing unit 23 is predicted from the travel distance of the developing roller 17 as indicated by the broken line of FIG. 11. That is, the column d in the table 3 shows the current change amount due to the actual deterioration of the developing roller 17, whereas the column e in the table 3 shows the current change amount due to the deterioration of the developing roller 17 predicted from the travel distance of the developing roller 17. In the case of the example shown in the table 3, it is understood that the current change amount (column d) due to the actual deterioration of the developing roller 17 is smaller than the predicted current change amount (column e).

A column f in the table 3 is correction coefficient for correcting the progression of the remaining lifetime amount of the developing unit 23 depending on a deviation amount between the change amount of the column d and the change amount of the column e. From the image output sheet number of 0 sheet until the toner accommodating unit 24 is subsequently exchanged, the remaining lifetime amount of the developing unit 23 is acquired depending on the travel distance of the developing roller 17 by taking the correction coefficient as 1. That is, in this period, the travel distance of the developing roller 17 is 5000 sheets in terms of the image output sheet number, the current change amount is 0.20 μA, and the remaining lifetime amount of the developing unit 23 at the timing of the exchange of the toner accommodating unit 24 is 75% (see the table 1). Further, after the toner accommodating unit 24 is first exchange at timing of the image output sheet number of 5000 sheets, the correction coefficient of the column f is acquired by calculation of (value of column d)/(value of column e). A correction coefficient determination operation for setting this correction coefficient is as described above with reference to FIG. 6. Further, until the toner accommodating unit 24 is subsequently exchange d, the remaining lifetime amount of the developing unit 23 is acquired depending on the travel distance of the developing roller 17 corrected using the correction coefficient acquired by the above-described calculation. An operation in which the remaining lifetime amount of the developing unit 23 is acquired using this correction coefficient and notification of the end of the lifetime of the developing unit 23 is provided is as described above with reference to FIG. 7.

This will be described specifically using the example shown in the table 3. First, the current flowing through the supplying roller 20 when both the developing unit 23 and the toner accommodating unit 24 are fresh articles (units) is taken as a reference current (initial current value). Further, the current change amount from the initial value at the time of the image output sheet number of 5000 sheets at which the exchange of the toner accommodating unit 24 is carried out is 0.20 μA as a predicted value, whereas is 0.17 μA in actuality. That is, until this timing, the deterioration of the developing roller 17 merely progresses to 84% relative to the predicted value in actuality. For this reason, the progression of the remaining lifetime amount of the toner accommodating unit 24 to timing when the current flowing through the supplying roller 20 after the subsequent exchange of the toner accommodating unit 24 is delayed by an amount corresponding to 84%. This correction is repeated every exchange of the toner accommodating unit 23. That is, on the basis of the current flowing through the supplying roller 20 measured in a state in which the influence due to the toner deterioration is minimum, the progression of the developing unit 23 is corrected, so that it becomes possible to make correction in which timing of notification of the end of the lifetime of the developing unit 23 is brought near to proper timing.

<Correction by Relative Humidity>

FIG. 12 is a graph showing a result of measurement in which a relationship between an ambient relative humidity of the developing unit 23 and the change amount, from the initial value, of the current flowing through the supplying roller 20 is measured using the developing unit 23 different in the deteriorated state of the developing roller 17. The current change amount from the initial value is a change amount in which the current flowing through the supplying roller 20 in an environment of 23° C./50% RH in the case where there is no deterioration of the developing roller 17 is taken as a reference current (value). A measurement environment (temperature/relative humidity) includes three kinds of 23° C./10% RH, 23° C./50% RH and 23° C./80% RH. From FIG. 12, it is understood that with an increasing relative humidity, the current flowing through the supplying roller 20 changes in the positive direction. This is attributable to that in the case where the relative humidity in the neighborhood of the toner is high, the negative electric charges possessed by the toner becomes small, and thus a charge amount per unit area (Q/S) of the negatively chargeable toner coated on the developing roller 17 becomes small.

Here, an experiment in which the current flowing through the supplying roller 20 is measured while changing the relative humidity is repetitively conducted, whereby it is possible to prepare a table showing a relationship between the relative humidity and the current flowing through the supplying roller 20 due to the difference in deteriorated state of the developing roller 17. A table 4 is an example of the table prepared in such a manner.

TABLE 4

| | | RELATIVE HUMIDITY (%) | | | | |
|---|---|---|---|---|---|---|
| | DTRRN*1 | 10 | 30 | 50 | 65 | 80 |
| CURRENT VALUE (μA) | NO | -0.05 | -0.03 | 0.00 | 0.20 | 0.40 |
| | ↑ | 0.15 | 0.15 | 0.15 | 0.30 | 0.50 |
| | \| | 0.30 | 0.30 | 0.30 | 0.40 | 0.60 |
| | \| | 0.45 | 0.45 | 0.45 | 0.55 | 0.70 |
| | ↓ | 0.60 | 0.60 | 0.60 | 0.70 | 0.80 |
| | MEDIUM | 0.80 | 0.80 | 0.80 | 0.85 | 0.90 |

*1: "DTRRN" is the deterioration.

In this embodiment, in the case where the relative humidity during the measurement of the current flowing through the supplying roller 20 is deviated from 50% RH, by making reference to table data as shown in the table 4, the current was converted into a current when the relative humidity is 50% RH (FIG. 6).

Comparison Example

Next, a comparison example used as an object to be compared with this embodiment in an experiment described later in which an effect of this embodiment is demonstrated will be described. In this comparison example, the remaining lifetime amount of the developing unit 23 is acquired from only the travel distance of the developing roller 17. In a low temperature/low humidity environment (15° C./10% RH) which is a relatively severe use (operation) condition from a viewpoint of the deterioration of the developing roller 17, the point of time when the image output sheet number reaches 20000 sheets in which the "fog" density on the recording material P exceeds 5% was taken as the end of the lifetime of the developing unit 23. Other structures and operations of the image forming apparatus 100 in this comparison example are substantially the same as those in this embodiment (the embodiment 1).

<Experiment>

In order to verify (demonstrate) the effect of this embodiment, evaluation was performed in environments different in temperature and humidity by using the image forming apparatus 100 of the comparison example and the image forming apparatus 100 of this embodiment. The "fog" density on the recording material P when the end of the lifetime of the developing unit 23 is notified was evaluated in the low temperature/low humidity (15° C./10% RH). A result is shown in a table 5.

TABLE 5

| | COMPARISON EXAMPLE | | EMBODIMENT | |
|---|---|---|---|---|
| ENVIRONMENT | L*1 (SHEETS) | F*2 (%) | L*1 (SHEETS) | F*2 (%) |
| 15° C./10% RH | 20000 | 5.0 | 20000 | 5.0 |
| 23° C./50% RH | 20000 | 3.5 | 27000 | 4.8 |
| 30° C./80% RH | 20000 | 3.0 | 30000 | 4.8 |

*1"L" is the lifetime
*2"F" is the fog.

In the comparison example, the actually deteriorated state of the developing roller 17 cannot be grasped, and therefore, timing (image output sheet number) when the end of the lifetime of the developing unit 23 is notified is unchanged depending on the environment. However, in the comparison example, the "fog" density on the recording material P when the end of the lifetime of the developing unit 23 is notified is different relatively largely. On the other hand, in this embodiment, the progression of the remaining lifetime amount of the developing unit 23 is corrected depending on the actually deteriorated state of the developing roller 17, and therefore, timing (image output sheet number) when the end of the lifetime of the developing unit 23 is notified changes depending on the environment. Further, in this embodiment, the "fog" density on the recording material P when the end of the lifetime of the developing unit 23 is notified is substantially constant irrespective of the environment.

In the comparison example, the timing of the notification of the end of the lifetime is set on the basis of the deteriorated state of the developing roller 17 in which the "fog" density in the low temperature/low humidity environment (15° C./10% RH) which is a relatively severe use condition (use environment) from the viewpoint of the deterioration of the developing roller 17 exceeds 5%. For that reason, between the comparison example and this embodiment, the timing (image output sheet number) when the end of the lifetime of the developing unit 23 is notified was substantially the same. However, in a normal temperature/normal humidity environment (23° C./50% RH), the timing when the end of the lifetime of the developing unit 23 is notified in this embodiment was after a lapse of 7000 sheets in terms of the image output sheet number from the end of the lifetime (20000 sheets) in the comparison example. Further, in this embodiment, the "fog" density on the recording material P when the end of the lifetime of the developing unit 23 was notified also does not exceed 5% which is an allowable value. This is because by actually measuring the deteriorated state of the developing roller 17 which is capable of being predicted on the basis of the current flowing through the supplying roller 20, notification of the end of the lifetime of the developing unit 23 is provided in conformity with the actually deteriorated state of the developing roller 17.

Thus, in the comparison example, in the case where a toner deterioration speed changes depending on the use condition, there is a deviation in some instances between the timing when the image defects actually occurs and the timing when the end of the lifetime of the developing unit 23 is notified. That is, in the comparison example, the end of the lifetime of the developing unit 23 is notified at timing when the developing unit 23 is still usable without causing the image defect in some instances. On the other hand, in this embodiment, the progression of the remaining lifetime amount of the developing unit 23 is corrected through measurement of the current flowing through the supplying roller 20, which correlates with the deteriorated state of the developing roller 17, and therefore, it is possible to notify the end of the lifetime of the developing unit 23 in conformity with the actually deteriorated state of the developing roller 17.

As described above, in the image forming apparatus 100 of this embodiment, the developing unit 23 including the developer carrying member 17 and the toner accommodating unit 24 are independently exchangeable. Further, in this embodiment, on the basis of the detection result of the current detector 34 at predetermined timing when the use of the fresh toner accommodating unit 24 is started, the controller 101 executes the process of notifying the information on the (end of) lifetime of the developing unit 23. Particularly, in this embodiment, in a process in which the remaining lifetime amount of the developing unit 23 is renewed and acquired on the basis of the index value correlating with the use amount of the developer carrying member 17, the controller 101 corrects a value (remaining lifetime amount decrease amount) corresponding to the decrease amount of the remaining lifetime amount of the developing unit 23 relative to an increase in use amount of the developer carrying member 17, on the basis of the detection result of the current detector 34. Further, in this embodiment, the controller 101 takes, as reference, the detection result of the current detector 34 at predetermined timing after a start of use of the fresh toner accommodating unit 24 from the state in which both the developing unit 23 and the toner accommodating unit 24 are the fresh articles (units), and sets a correction amount (correction range of the remaining lifetime amount decrease amount determined by the correction coefficient) in the correction on the basis of the change amount from the reference for the detection result of the current detector 34 at the predetermined timing acquired every start of the use of the fresh toner accommodating unit 24. In this embodiment, the controller 101 sets the correction amount in the following manner. A difference between the change amount acquired after use of a certain fresh toner accommodating unit 24 is started and the change amount acquired after use of a subsequent fresh toner accommodating unit 24 is started includes a first value and a second value smaller than the first value. The controller 101 sets the correction amount so that the correction amount in the correction after the use of the subsequent fresh toner accommodating unit 24 is started is larger in the case where the difference is the second value than in the case where the difference is the first value. In this embodiment, the above-described index value is a value corresponding to the number of images outputted by using the developer carrying member 17. Further, in this embodiment, a lifetime period of the developing unit 3 is longer than a lifetime period of the toner accommodating unit 24.

According to this embodiment, it is possible to accurately provide the notification of the information on the (end of) lifetime of the unit (developing unit 23) including the developing roller 17 depending on the deterioration of the developing roller 17 due to the filming.

Embodiment 2

Next, another embodiment of the present invention will be described. Basic constitution and operation of an image forming apparatus of this embodiment are the same as those of the image forming apparatus of the embodiment 1. Accordingly, in the image forming apparatus of this embodiment, elements having functions or structures which are the same as or correspond to those in the embodiment 1 are represented by the same reference numerals or symbols and will be omitted from detailed description.

In this embodiment, the remaining lifetime amount of the developing unit 23 is acquired by a method similar to the method in the embodiment 1. In addition, in this embodiment, in the case where the remaining lifetime amount of the developing unit 23 is a predetermined remaining lifetime amount or less, the remaining lifetime amount of the developing unit 23 is corrected in the following manner. That is, the remaining lifetime amount of the developing unit 23 is corrected depending on a remaining toner amount so that the developing unit 23 and the toner accommodating unit 24 reach ends of lifetimes thereof at the same time. By this, it is possible to suppress that the developing unit 23 reaches the end of the lifetime thereof in a state in which the toner remains in the toner accommodating unit 24. Here, "the developing unit 23 and the toner accommodating unit 24 reach end of the lifetimes thereof at the same time" refers to that the ends of the lifetimes of the developing unit 23 and the toner accommodating unit 24 can be notified substantially at the same time so that these units can be exchanged simultaneously.

In this embodiment, after the remaining lifetime amount after the correction of the developing unit 23 described in the embodiment 1 becomes 25% or less, the remaining lifetime amount after the exchange of the toner accommodating unit 24 is made is linked with the remaining lifetime amount of the toner accommodating unit 24 depending on the remaining toner amount of the toner accommodating unit 24. That is, for example, as shown in table 6, it is assumed that the exchange of the toner accommodating unit 24 is carried out when the remaining lifetime amount of the developing unit 23 is 24%. In this case, immediately after the exchange, the remaining toner amount of the toner accommodating unit 24 is 100%, and the remaining lifetime amount of the developing unit 23 is 24%. In this case, as shown in the table 6, ranges from 100% to 0% of the remaining lifetime amount of the toner accommodating unit 24 are assigned to ranges from 100% to 0%, respectively, of the remaining lifetime amount of the developing unit 23. As a result, in a period in which the remaining lifetime amount of the toner accommodating unit 24 subsequently changes from 100% toward 0%, the remaining lifetime amount of the developing unit 23 correspondingly changes from 24% toward 0%. Accordingly, it becomes possible to simultaneously notify the end of the lifetime of the developing unit 23 and the end of the lifetime of the toner accommodating unit 24. By this, it is possible to suppress that the end of the lifetime of the developing unit 23 is notified in the state in which the toner remains in the toner accommodating unit 24 (in a state in which the end of the lifetime of the toner accommodating unit 24 is not notified). That is, it becomes possible to exchange the developing unit 23 and the toner accommodating unit 24 at the same time, so that it becomes possible to deduce uselessness of an operation required for exchange of the units.

TABLE 6

| TAURLA*[1] (%) | DURLA*[2] (%) |
|---|---|
| 100 | 24 |
| 75 | 18 |
| 50 | 12 |
| 25 | 6 |
| 0 | 0 |

*[1]"TAURLA" is the toner accommodating unit remaining lifetime amount.
*[2]"DURLA" is the developing unit remaining lifetime amount.

Thus, in this embodiment, in the case where the remaining lifetime amount of the developing unit 23 is predetermined value or less, the controller 100 acquires the remaining lifetime amount of the developing unit 23 on the basis of the amount of the toner in the toner accommodating unit 24.

In this embodiment, on the basis of each of assumed outputtable sheet numbers of the toner accommodating unit 24 and the developing unit 23, a calculating method of the remaining lifetime amount of the developing unit 23 was switched when the remaining lifetime amount of the developing unit 23 is 25% or less. However, timing when the method of acquiring the remaining lifetime amount of the developing unit 23 is switched from the method in the embodiment 1 to the method in this embodiment (the second embodiment) is not limited to the above-described timing, but may preferably be appropriately determined depending on specifications of the toner accommodating unit 24 and the developing unit 23. For example, for the toner accommodating unit 24 of which assumed outputtable sheet number is ½ of the assumed outputtable sheet number in this embodiment, the above-described switching timing may preferably be set in the following manner. That is, the timing is after the toner accommodating unit 24 is exchanged after the remaining lifetime amount of the developing unit 23 is not 25% or less but is 12% or less.

Other Embodiments

The present invention was described above based on the specific embodiments, but is not limited thereto.

In the above-described embodiments, the color image forming apparatus was described as an example, but the present invention may also be applied to a monochromatic image forming apparatus. Further, in the above-described embodiments, the image forming apparatus employing the intermediary transfer type was described as an example, but the present invention may also be applied to an image forming apparatus employing a direct transfer type in which toner images of respective colors are successively and superposedly transferred onto the recording material carried on a recording material carrying member.

Further, in the above-described embodiments, as the image forming apparatus, the printer was described as an example, but the present invention is not limited thereto. For example, the present invention may also be applied to other image forming apparatuses such as a copying machine, a facsimile machine, another printer and a multi-function machine having a combination of functions of these machines.

According to the present invention, notification of the information on the (end of) lifetime of the unit including the developer carrying member depending on a degree of the deterioration of the developer carrying member can be provided with accuracy.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-090254 filed on May 10, 2019, which is hereby incorporated by reference herein in its entirety.

What is claimed is:

1. An image forming apparatus comprising:

an image bearing member configured to bear a toner image;

a rotatable developer carrying member configured to carry and feed toner to a portion where said image bearing member is opposed;

a rotatable supplying member configured to supply the toner to said developer carrying member in contact with said developer carrying member;

a toner accommodating unit in which the toner to be supplied to said developer carrying member is accommodated;

wherein a developing unit including said developer carrying member and said toner accommodating unit are capable of being independently exchanged, a current detector configured to detect a current flowing through said supplying member; and a controller configured to correct a value corresponding to a decrease amount of a remaining lifetime amount of said developing unit relative to an increase of a use amount of said developer carrying member on the basis of a detection result of said current detector at a predetermined timing after use of a fresh toner accommodating unit is started, such that the remaining lifetime amount of said developing unit is renewed and acquired on the basis of the use amount of said developer carrying member.

2. An image forming apparatus according to claim 1, wherein when the detection result of said current detector at the predetermined timing after use of the fresh toner accommodating unit is started from a fresh state of each of said developing unit and said toner accommodating unit is taken as a reference value, said controller sets a correction amount in the correction on the basis of change amount of the detection result of said current detector from the reference value at the predetermined timing acquired every start of the use of the fresh toner accommodating unit.

3. An image forming apparatus according to claim 2, wherein when a difference between the change amount acquired after use of a certain fresh toner accommodating unit is started and the charge amount acquired after use of a subsequent fresh toner accommodating unit is started is a first value and a value smaller than the first value is a second value, said controller sets the correction amount in the correction so that the correction amount after the use of the subsequent fresh toner accommodating unit is started is larger when the difference is the second value than when the difference is the first value.

4. An image forming apparatus according to claim 1, wherein when the remaining lifetime amount of said developing unit is a predetermined amount or less, said controller acquires the remaining lifetime amount of said developing unit on the basis of an amount of the toner in said toner accommodating unit.

5. An image forming apparatus according to claim 1, further comprising environment detector configured to detect an ambient environment of said developing unit, wherein said controller converts the detection result of said current detector into a detection result of said current detector in a predetermined environment on the basis of a detection result of said current detector when a current flowing through said supplying member is detected by said current detector and information on a relationship between a detection result of said environment detector and the detection result of said current detector.

6. An image forming apparatus according to claim 1, wherein said index value is a value corresponding to the number of images outputted using said developer carrying member.

7. An image forming apparatus according to claim 1, wherein a lifetime period of said developing unit is longer than a lifetime period of said toner accommodating unit.

8. An image forming apparatus according to claim 1, wherein said developer carrying member and said supplying member rotates so that surfaces thereof move in the same direction with a predetermined speed difference at a contact portion therebetween.

9. An image forming apparatus according to claim 1, wherein during detection of the current, a potential difference between said developer carrying member and said supplying member is 50 V or less.

10. An image forming apparatus according to claim 1, wherein during detection of the current, a potential difference between said developer carrying member and said supplying member is substantially the same as a potential difference during an image forming operation.

11. An image forming apparatus according to claim 1, further comprising contact and separation means configured to contact said developer carrying member to said image bearing member and to separate said developer carrying member from said image bearing member, wherein during detection of the current, said developer carrying member is separated from said image bearing member by said contact and separation means.

12. An image forming apparatus according to claim 1, wherein said supplying member is 1×108 (Ω) in electric resistance.

13. An image forming apparatus comprising:

an image bearing member configured to bear a toner image;

a rotatable developer carrying member configured to carry and feed toner to a portion where said image bearing member is opposed;

a rotatable supplying member configured to supply the toner to said developer carrying member in contact with said developer carrying member;

a toner accommodating unit in which the toner to be supplied to said developer carrying member is accommodated and which is capable of supplying fresh toner when an amount of the toner accommodated therein is a predetermined amount or less;

wherein a developing unit including said developer carrying member is capable of being exchanged, a current detector configured to detect a current flowing through said supplying member; and a controller configured to correct a value corresponding to a decrease amount of a remaining lifetime amount of said developing unit relative to an increase of a use amount of said developer carrying member on the basis of a detection result of said current detector at predetermined timing after use of a fresh toner accommodating unit is started, such that the remaining lifetime amount of said developing unit is renewed and acquired on the basis of the use amount of said developer carrying member.

* * * * *